US011564541B2

(12) United States Patent
Hwang et al.

(10) Patent No.: US 11,564,541 B2
(45) Date of Patent: Jan. 31, 2023

(54) VACUUM CLEANER

(71) Applicant: LG ELECTRONICS INC., Seoul (KR)

(72) Inventors: Jung Bae Hwang, Seoul (KR); Jinrae Cho, Seoul (KR); Phil Jae Hwang, Seoul (KR); Chung Jae Ryu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 171 days.

(21) Appl. No.: 16/985,258

(22) Filed: Aug. 5, 2020

(65) Prior Publication Data

US 2021/0212534 A1 Jul. 15, 2021

(30) Foreign Application Priority Data

Jan. 10, 2020 (KR) ..... 10-2020-0003717

(51) Int. Cl.
*A47L 9/04* (2006.01)
*A46B 13/02* (2006.01)

(52) U.S. Cl.
CPC ..... *A47L 9/0477* (2013.01); *A46B 13/02* (2013.01); *A47L 9/0411* (2013.01); *A47L 9/0455* (2013.01); *A46B 2200/30* (2013.01)

(58) Field of Classification Search
CPC ... A47L 5/30; A47L 5/26; A47L 5/225; A47L 9/0455; A47L 9/0411; A47L 9/0477; A46B 13/02; A46B 2200/30
(Continued)

(56) References Cited

U.S. PATENT DOCUMENTS 5,193,243 A * 3/1993 Stegens ..... A47L 9/0455 492/29
6,530,106 B1 * 3/2003 Brundula ..... A46B 13/001 15/179

(Continued)

FOREIGN PATENT DOCUMENTS

CN 103829882 A 6/2014
JP 2009-189795 A 8/2009

(Continued)

OTHER PUBLICATIONS

Wikipedia, Bulk Density, Oct. 22, 2021, https://en.wikipedia.org/wiki/Bulk_density (Year: 2021).*

(Continued)

*Primary Examiner* — Andrew A Horton
(74) *Attorney, Agent, or Firm* — Birch, Stewart, Kolasch & Birch, LLP

(57) ABSTRACT

A vacuum cleaner includes a main body and a suction nozzle that suctions up dust on the floor. The suction nozzle includes a housing, a driver, and a rotating brush. The housing includes an entrance through which the dust travels to the main body, a first shaft member, and a first rib disposed along a circumference of the first shaft member. The rotating brush includes a cylindrical body rotated by the first shaft member. The rotating brush also includes a brush member attached to an outer surface of the cylindrical body. The brush member rubs against the floor to direct the dust on the floor towards the entrance. As the brush member rotates, it also comes into contact with the first rib. The brush member includes a plurality of filaments. Some of the filaments are elastically deformed in the direction of the rotation axis upon contacting the first rib.

17 Claims, 16 Drawing Sheets

(58) Field of Classification Search
USPC ..... 15/318, 383, 392
See application file for complete search history.

(56) References Cited

U.S. PATENT DOCUMENTS

| | | | | |
|---|---|---|---|---|
| 9,217,984 | B1 * | 12/2015 | Fujii | G03G 21/105 |
| 9,320,399 | B2 * | 4/2016 | Ventress | A46B 9/026 |
| 9,480,374 | B2 * | 11/2016 | Li | A47L 5/30 |
| 2010/0287717 | A1 * | 11/2010 | Jang | A47L 11/24 15/41.1 |
| 2015/0265117 | A1 * | 9/2015 | Genn | A47L 9/0455 15/363 |
| 2016/0220084 | A1 * | 8/2016 | Xu | A47L 9/0444 |
| 2018/0125315 | A1 * | 5/2018 | Kasper, Jr. | A47L 9/0444 |
| 2018/0303304 | A1 * | 10/2018 | Yang | A47L 9/0411 |
| 2019/0000289 | A1 * | 1/2019 | Lim | A47L 5/36 |

FOREIGN PATENT DOCUMENTS

| | | | |
|---|---|---|---|
| KR | 10-1992-0011435 | A | 7/1992 |
| KR | 10-2017-0090708 | A | 8/2017 |
| KR | 10-2018-0023401 | A | 3/2018 |
| KR | 10-2019-0080855 | A | 7/2019 |
| TW | 201838576 | A | 11/2018 |

OTHER PUBLICATIONS

Wikipedia, Packing Density, Dec. 31, 2021, https://en.wikipedia.org/wiki/Bulk_density (Year: 2021).*

International Search Report, dated Feb. 2, 2021, issued in PCT Patent Application No. PCT/KR2020/015983 (3 pages).

Office Action, dated Feb. 22, 2021, issued in Taiwanese Patent Application No. 109123768 (14 pages).

* cited by examiner

VACUUM CLEANER

CROSS-REFERENCE TO RELATED APPLICATION

This application claims benefit of priority to Korean Patent Application No. 10-2020-0003717, entitled "VACUUM CLEANER" and filed on Jan. 10, 2020, in the Korean Intellectual Property Office, the entire disclosure of which is incorporated herein by reference.

BACKGROUND

1. Technical Field

The present disclosure relates to a vacuum cleaner, and more particularly, to a vacuum cleaner capable of cleaning dust on a smooth floor by using a rotating brush.

2. Background

Vacuum cleaners may have different cleaning capabilities depending on the type of brush mounted therein.

When cleaning uneven carpets, a carpet brush made of a stiff plastic material is advantageous in terms of cleaning efficiency.

Meanwhile, when cleaning smooth floors or papered floors, a floor brush made of a soft flannel is advantageous in terms of cleaning efficiency.

Using the floor brush made of the soft flannel prevents scratching of the floor due to the brush. In addition, when the brush made of the soft flannel is rotated at a high speed, fine dust adhering to the floor is separated from the floor by the high speed rotation of the brush, and as a result, the separated fine dust may be suctioned up and thus removed.

In this regard, in Korean Patent Application Publication No. 10-2019-0080855 (published on Jul. 8, 2019; hereinafter referred to as "related art 1"), disclosed is a vacuum cleaner. The vacuum cleaner according to related art 1 includes a cleaner body and a suction nozzle. The suction nozzle includes a housing, a rotary cleaning unit, a driving unit, and a rotation supporting portion.

The housing includes a first side cover and a second side cover. The first side cover and the second side cover are provided on both sides of the rotary cleaning unit.

The rotary cleaning unit is configured to move foreign substances, such as hair and dust, toward the rear thereof by sweeping the foreign substances off the floor using a plurality of filaments. The rotation supporting portion and the driving unit are disposed at both ends of the rotary cleaning unit.

The driving unit is inserted into one side of the rotary cleaning unit. The driving unit transfers a driving force to the rotary cleaning unit. The driving unit is fixed to the first side cover. The first side cover is coupled to the housing. The rotary cleaning unit rubs against the floor by being rotated by the driving force transferred by the driving unit. A friction force between the rotary cleaning unit and the housing may reduce a rotational speed of the rotary cleaning unit. Accordingly, the plurality of filaments at one end of the rotary cleaning unit are slightly spaced apart from or lightly come into contact with the housing.

The rotation supporting portion is inserted into the end of the rotary cleaning unit on the opposite side of the driving unit. The rotation supporting portion rotatably supports the rotating cleaning unit. The rotation supporting portion is provided on the second side cover. A friction force between the rotary cleaning unit and the second side cover may reduce the rotational speed of the rotary cleaning unit. Accordingly, the plurality of filaments at the other end of the rotary cleaning unit are slightly spaced apart from or lightly come into contact with the second side cover.

However, according to the vacuum cleaner according to related art 1, foreign substances such as hair and dust on the floor may pass between the plurality of filaments and the housing and between the plurality of filaments and the second side cover, and then enter the rotation supporting portion and the driving unit. The foreign substances that enter between a rotating object and a fixed object interfere with the rotational motion between the rotating object and the fixed object. This leads to loss of driving force. As a result, a rotating force of the rotary cleaning unit may decrease, thereby reducing a force of moving the foreign substances on the floor backward.

However, in order to prevent this situation, by bringing the plurality of filaments into close contact with each of the housing and the second side cover, the friction force between the filaments and the housing and between the filaments and the second side cover increases. As a result, the rotating force of the rotary cleaning unit may decrease, thereby reducing the force of moving the foreign substances on the floor backward.

Meanwhile, the filaments are directed in one direction over a fiber layer. That is, planted filaments are directed obliquely in one direction. As an example, the filaments may be directed along a longitudinal direction of a nozzle body. In addition, the filaments may be directed along a circumferential direction of the nozzle body. Further, the filaments may be directed along a spiral direction of the nozzle body.

During rotation of the rotary cleaning unit, as the plurality of filaments repeatedly come into contact with the floor, a process in which the plurality of filaments are bent and then unfolded is repeated. In this process, foreign substances such as hair and dust move to the end of the rotary cleaning unit along the grain of the filaments.

The foreign substances such as hair and dust ① may enter the rotation supporting portion and the driving unit directly from the floor between the plurality of filaments and the housing and between the plurality of filaments and the second side cover, or ② may move to the end of the rotary cleaning unit along the grain of the filaments while adhering to the filaments and then enter the rotation supporting portion and the driving unit.

Entry of the hair and dust into the rotation supporting portion and the driving unit directly from the floor is limited to occurring in a lower portion of the rotary cleaning unit. Movement of the head end dust to the end of the rotary cleaning unit along the grain of the filaments occurs constantly along a circumferential direction of the rotary cleaning unit. Accordingly, the foreign substances such as hair and dust mainly enter the rotation supporting portion and the driving unit at a bottom of the rotary cleaning unit. The inventors of the present disclosure have studied a d that is capable of simultaneously minimizing the loss of driving force due to the friction force and the loss of driving force due to the foreign substances.

SUMMARY

The present disclosure is directed to providing a vacuum cleaner that is capable of eliminating loss of rotating force due to foreign substances such as hair and dust adhering to a rotating brush, even if the foreign substances move along the grain of filaments to the end of the rotating brush.

The present disclosure is further directed to providing a vacuum cleaner that is capable of preventing foreign substances such as hair and dust on a floor from entering between the rotating brush and a housing and between the rotating brush and a detachable cover at both ends of the rotating brush.

The present disclosure is still further directed to providing a vacuum cleaner that is capable of minimizing loss of rotating force due to friction force while eliminating loss of rotating force due to the foreign substances.

In a vacuum cleaner according to an embodiment of the present disclosure, a first rib formed in a housing may come into contact with a brush member along a circumference of a first shaft member. Accordingly, even if foreign substances such as hair and dust adhering to the rotating brush move to ends of the rotating brush along the grain of filaments, loss of rotating force of the rotating brush due to the foreign substances may be prevented.

A vacuum cleaner according to an embodiment of the present disclosure may include a main body and a suction nozzle.

The main body may be configured to generate an air pressure difference. A blower may be provided inside the main body.

The suction nozzle may suction up dust on the floor through the generated air pressure difference.

The suction nozzle may include a housing, a driver, a rotating brush, and a detachable cover.

The housing may have an entrance through which dust may move to the main body. The entrance may be formed on a rear side of the housing. The entrance may have a cylindrical shape.

The driver may be installed in the housing. The driver may generate a rotating force. The driver may rotate a first shaft member. The driver may include a motor and a transmission device.

The rotating brush may be rotated to push dust on the floor toward the entrance.

The rotating brush may include a cylindrical body and a brush member.

The cylindrical body may receive rotational motion of the first shaft member. The driver may transmit rotational motion to the cylindrical body. The cylindrical body may have a hollow cylindrical shape.

The brush member may be attached to an outer surface of the cylindrical body so as to rub against the floor. The brush member may include a plurality of filaments that are elastically deformed by the floor and that push the dust toward the entrance. The plurality of filaments may be formed of a soft material that may be elastically deformed by an external force.

A first rib may be formed in the housing. The first rib may protrude from the housing in a direction of a rotation axis of the cylindrical body so as to contact the brush member.

A radius of the outermost portion of the brush member centered on the rotation axis of the cylindrical body may be greater than a distance between the rotation axis of the cylindrical body and the first rib. Accordingly, the first rib may be interposed between the housing and the brush member such that a gap between the housing and the brush member is blocked. As a result, it is possible to prevent foreign substances from entering between the housing and the brush member.

The first rib may include a first A rib and a first B rib. The first A rib and the first B rib may be connected to each other. The first A rib and the first B rib may have a shape surrounding a circumference of the first shaft member.

The first A rib may be formed at a predetermined distance from the rotation axis of the cylindrical body. The first A rib may be formed along the circumferential direction around the rotation axis of the cylindrical body.

The radius of the outermost portion of the brush member centered on the rotation axis of the cylindrical body may be greater than a distance between the rotation axis of the cylindrical body and the first A rib. Accordingly, even when the rotating brush rotates, the first A rib and the brush member may be in continuous contact with each other.

The first B rib may be provided below the rotating shaft. The first B rib may be formed at a predetermined distance from the floor. Accordingly, the first B rib may be at the shortest distance from the central axis of the cylindrical body at a position directly below the central axis of the cylindrical body. Accordingly, even when the rotating brush rotates, the first B rib and the brush member may be in continuous contact with each other.

The filaments may be classified into a plurality of first filaments, a plurality of second filaments, and a plurality of third filaments according to a shape of elastic deformation thereof.

The first filaments may denote filaments spaced apart from the first rib. The first filaments may be elastically deformed only by friction with the floor when the cylindrical body rotates.

The second filaments may denote the filaments interposed between the outer surface of the cylindrical body and the first rib. When a second shaft member of the rotating brush is fitted to the first shaft member, the second filaments may be interposed between the outer surface of the cylindrical body and the first rib.

The second filaments may be elastically deformed by friction with the first rib when the cylindrical body rotates. As a length of the first rib protruding in the direction of the rotation axis increases, the number of the second filaments may increase.

When the cylindrical body rotates, an amount of elastic deformation of the second filaments may be greater than an amount of elastic deformation of the first filaments. Accordingly, the second filaments may have a higher bulk density than the first filaments.

The third filaments may denote filaments that are elastically deformed in the direction of the rotation axis by being pushed by the first rib. When the second shaft member of the rotating brush is fitted to the first shaft member, the third filaments may be pushed in the direction of the rotation axis by the first rib.

The third filaments may be elastically deformed only by friction with the floor when the cylindrical body rotates. When the cylindrical body rotates, a total amount of elastic deformation of the third filaments may be greater than an amount of elastic deformation of the first filaments. Accordingly, the third filaments may have a higher bulk density than the first filaments.

The second filaments and the third filaments may have a higher bulk density when coming into contact with the first B rib than when coming into contact with the first A rib. Accordingly, a phenomenon in which foreign substances such as hair and dust on the floor directly enter between the rotating brush and the housing and between the rotating brush and the detachable cover at both ends of the rotating brush may be prevented.

The rotating brush may rotate in engagement with the first shaft member.

The detachable cover may rotatably support the rotating brush on the opposite side of the first shaft member.

The detachable cover may be provided with a second rib that comes into contact with the brush member. The second rib may protrude from the detachable cover in the direction of the rotation axis of the cylindrical body.

The radius of the outermost portion of the brush member centered on the rotation axis of the cylindrical body may be greater than a distance between the rotation axis of the cylindrical body and the second rib. Accordingly, the second rib may be interposed between the detachable cover and the brush member such that a gap between the detachable cover and the brush member is blocked. As a result, it may be possible to prevent foreign substances from entering between the detachable cover and the brush member.

The second rib may include a second A rib and a second B rib. The second A rib and the second B rib may be connected to each other.

The second A rib may be formed at a predetermined distance from the rotation axis of the cylindrical body. The second A rib may be provided in front of the rotating shaft. The second A rib may be formed along the circumferential direction around the rotation axis of the cylindrical body.

The radius of the outermost portion of the brush member centered on the rotation axis of the cylindrical body may be greater than a distance between the rotation axis of the cylindrical body and the second A rib. Accordingly, even when the rotating brush rotates, the second A rib and the brush member may be in continuous contact with each other.

The second B rib may be provided below the rotating shaft. The second B rib may be formed at a predetermined distance from the floor. Accordingly, the first B rib may be at the shortest distance from the central axis of the cylindrical body at the position directly below the central axis of the cylindrical body. Accordingly, even when the rotating brush rotates, the first B rib and the brush member may be in continuous contact with each other.

The second filaments may be interposed between the outer surface of the cylindrical body and the second rib. When the cylindrical body is rotatably connected to the detachable cover, the second filaments may be interposed between the outer surface of the cylindrical body and the second rib.

The second filaments may be elastically deformed by friction with the second rib when the cylindrical body rotates. As the length of the second rib protruding in the direction of the rotation axis increases, the number of the second filaments may increase.

The third filaments may be elastically deformed in the direction of the rotation axis by being pushed by the second rib. When the cylindrical body is rotatably connected to the detachable cover, the third filaments may be pushed in the direction of the rotation axis by the second rib.

The second filaments and the third filaments may increase in bulk density as they go toward a direction directly downward of the rotation axis. Accordingly, a phenomenon in which foreign substances such as hair and dust on the floor directly enter between the rotating brush and the housing and between the rotating brush and the detachable cover at both ends of the rotating brush may be prevented.

According to the embodiments of the present disclosure, since the first rib disposed along the circumference of the first shaft member protrudes from the housing in the direction of the rotation axis of the cylindrical body such that the second and third filaments having a larger bulk density are disposed along the circumferential direction of the brush member, even if foreign substances such as hair and dust adhering to the rotating brush move to the ends of the rotating brush along the grain of the filaments, a phenomenon in which foreign substances pass through the second and third filaments and then move toward the first shaft member may be prevented.

According to the embodiments of the present disclosure, since the first B rib and the second B rib provided below the rotation axis are formed at a predetermined distance from the floor, respectively, such that the second and third filaments increase in bulk density as they go toward the direction directly downward of the rotation axis, a phenomenon in which foreign substances such as hair and dust on the floor pass through the second and third filaments at both ends of the rotating brush and then move toward the first and third shaft members can be prevented.

According to the embodiments of the present disclosure, since the first A rib and the second A rib are formed at a predetermined distance from the rotating shaft of the cylindrical body while the second filaments and the third filaments increase in bulk density as they go toward the direction directly downward of the rotation axis, which allows foreign substances on the floor to penetrate directly into the first and third shaft members, it may be possible to prevent foreign substances on the floor from directly penetrating into the first and third shaft members while minimizing a total amount of loss of rotating force.

DETAILED DESCRIPTION

Hereinafter, the embodiments disclosed in this specification will be described in detail with reference to the accompanying drawings. The detailed description of related known technology will be omitted when it may obscure the subject matter of the embodiments according to the present disclosure.

Figure 1:
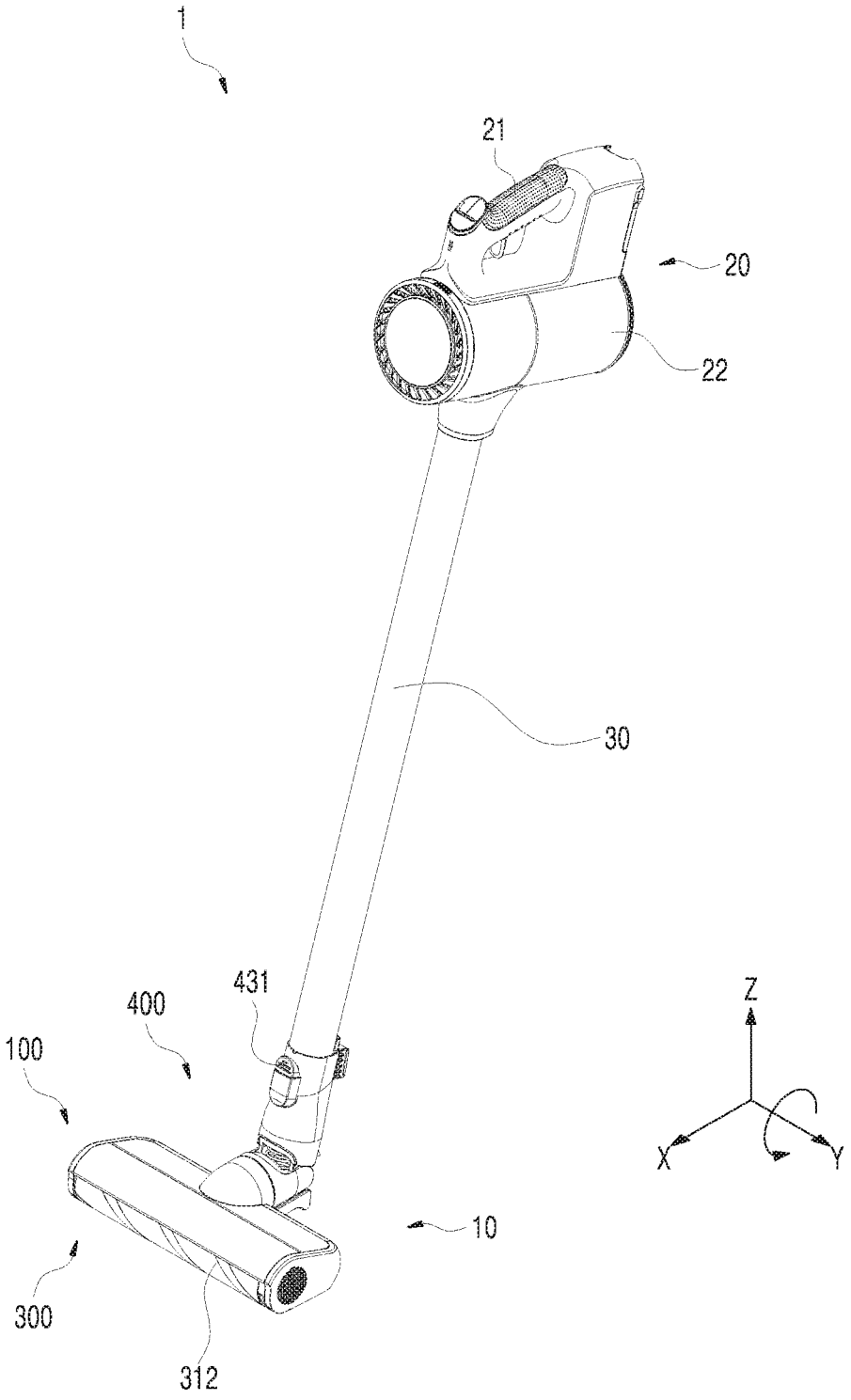
FIG. 1 is a perspective view of a vacuum cleaner according to an embodiment of the present disclosure.

FIG. 1 is a perspective view of a vacuum cleaner 1 according to an embodiment of the present disclosure.

As illustrated in FIG. 1, a vacuum cleaner 1 according to an embodiment of the present disclosure includes a main body 20 and a suction nozzle 10.

The suction nozzle 10 is connected to the main body 20 through an extension pipe 30. The suction nozzle 10 may be directly connected to the main body 20. A user may grip a handle 21 provided on the main body 20 and move the suction nozzle 10 on a floor backward and forward.

The main body 20 is configured to generate an air pressure difference. A blower is provided inside the main body 20. When the blower generates the air pressure difference, foreign substances such as dust on the floor move from an entrance 111 (see FIG. 3) of the suction nozzle 10 through the extension pipe 30 to the main body 20.

A centrifugal dust collector may be provided inside the main body 20. The foreign substances such as dust may be stored in a dust container 22.

Figure 2:
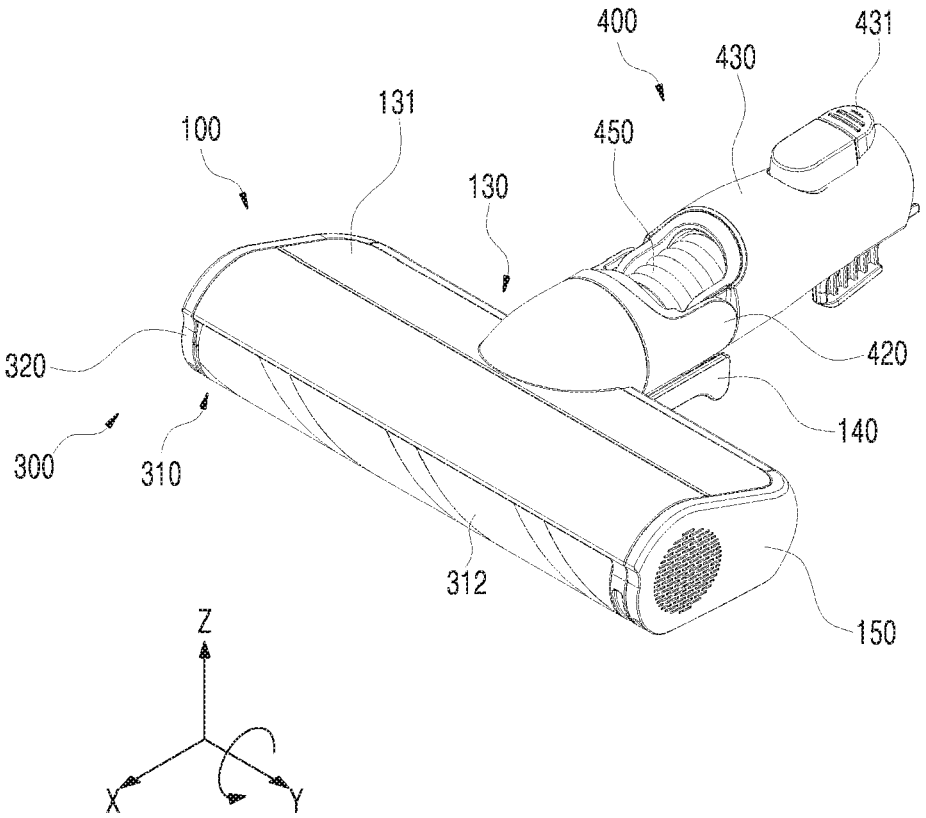
FIG. 2 is a perspective view of a suction nozzle of the vacuum cleaner illustrated in FIG. 1, as viewed from above, consistent with embodiments of the present disclosure.
Figure 3:
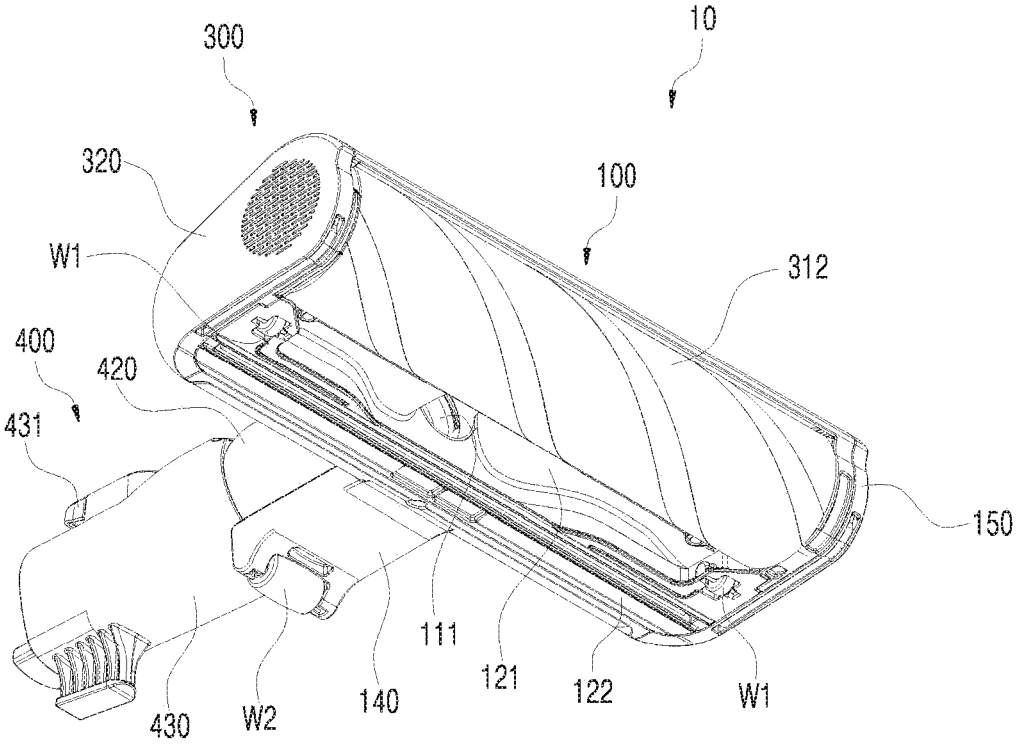
FIG. 3 is a perspective view of the suction nozzle of the vacuum cleaner illustrated in FIG. 1, as viewed from below, consistent with embodiments of the present disclosure.
Figure 4:
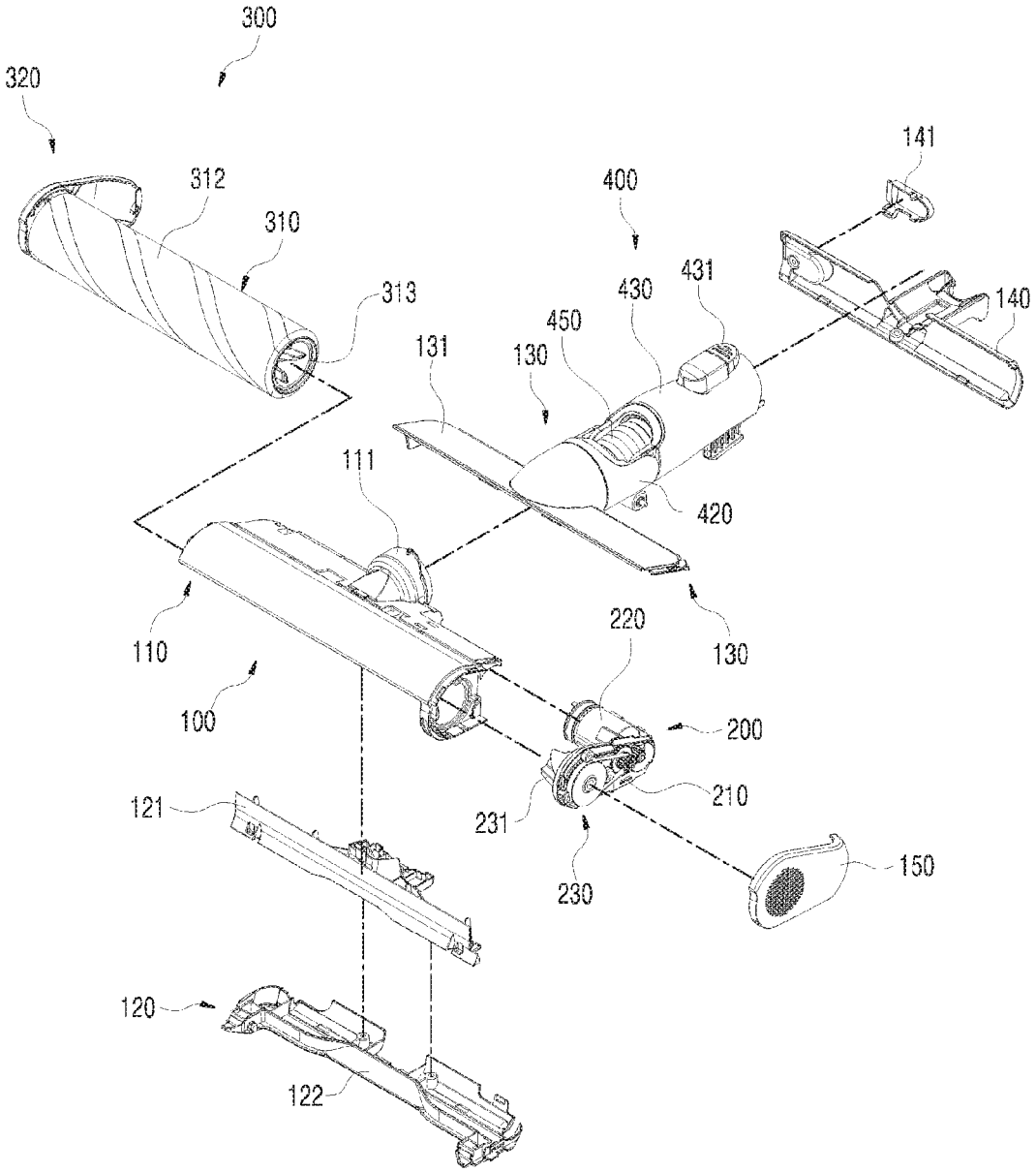
FIG. 4 is an exploded perspective view of the suction nozzle illustrated in FIG. 2, consistent with embodiments of the present disclosure.

FIG. 2 is a perspective view of the suction nozzle 10 of the vacuum cleaner 1 illustrated in FIG. 1, as viewed from above. FIG. 3 is a perspective view of the suction nozzle 10 of the vacuum cleaner 1 illustrated in FIG. 1, as viewed from below FIG. 4 is an exploded perspective view of the suction nozzle 10 illustrated in FIG. 2.

The suction nozzle 10 is configured to suction up dust on the floor through the air pressure difference. The suction nozzle 10 includes a housing 100, a driver 200, a brush module 300, and a connector 400.

The main technical feature of the present disclosure consists in a rotating brush 310 of the brush module 300. Accordingly, the housing 100, the driver 200 and the connector 400 will be briefly described.

Hereinafter, for easy understanding of the present disclosure, the side of the suction nozzle 10 where the rotating brush 300 is located is referred to as a front side of the suction nozzle 10, and the side of the suction nozzle 10 where the connector 400 is located is referred to as a rear side of the suction nozzle 10.

A three-dimensional Cartesian coordinate system is shown in FIGS. 1 to 3. A direction indicated by an X-axis in the three-dimensional Cartesian coordinate system denotes the aforementioned front side. A direction indicated by a Y-axis in the three-dimensional Cartesian coordinate system denotes a direction parallel to a rotation axis of the rotating brush. A direction indicated by a Z-axis in the three-dimensional Cartesian coordinate system denotes an upward direction.

The order of assembling the suction nozzle 10 is as follows. First, the connector 400 is assembled. Then, a mounting housing 130 is connected to the connector 400. That is, the mounting housing 130 is rotatably mounted to the connector 400. Then, the driver 200 is coupled to one side of a body housing 110.

Thereafter, the mounting housing 130 is coupled to an upper portion of the body housing 110. Then, a lower housing 120 is coupled to a lower portion of the body housing 110. Then, a supporting housing 140 is coupled to the lower portion of the body housing 110. Then, a push button 141 is mounted on the supporting housing 140. Then, a side cover 150 is coupled to one side of the body housing 110.

Finally, a first shaft member 231 is fitted to a second shaft member 313 of the rotating brush 310, and a detachable cover 320 is detachably coupled to the other side of the body housing 110. As a result, the assembling of the suction nozzle 10 is completed.

Figure 5:
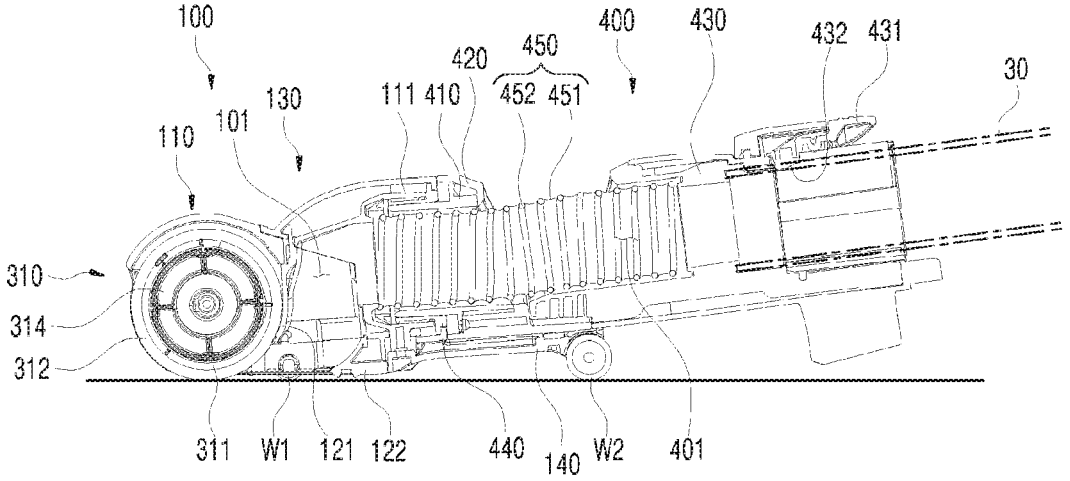
FIG. 5 is a cross-sectional view of the suction nozzle illustrated in FIG. 2, consistent with embodiments of the present disclosure.

FIG. 5 is a cross-sectional view of the suction nozzle 10 illustrated in FIG. 2.

As illustrated in FIGS. 4 and 5, the housing 100 is configured to guide foreign substances, such as dust on the floor, into a passage 401 of the connector 400.

The housing 100 includes the body housing 110, the lower housing 120, the mounting housing 130, and the supporting housing 140.

The body housing 110 is provided with the entrance 111 through which dust moves to the main body 20. The entrance 111 is formed at a rear side of the body housing 110. The entrance 111 has a cylindrical shape. The rotating brush 310 is mounted on a front side of the body housing 110.

The rotating brush 310 is rotated by the driver 200. The rotating brush 310 scrapes foreign substances such as dust on the floor and pushes them toward a rear side of the rotating brush 310. The foreign substances such as dust pushed toward the rear side of the rotating brush 310 may easily enter into the entrance 111. The body housing 110 covers the floor between the rotating brush 310 and the entrance 111.

A space of the housing 100 between the rotating brush 310 and the entrance 111 forms a space (hereinafter referred to as a "suction space 101") between the housing 100 and the floor. The suction space 101 is isolated from an outside except for the space between the housing 100 and the floor. The foreign substances such as dust in the suction space 101 enter the passage 401 through the entrance 111.

As illustrated in FIGS. 4 and 5, the lower housing 120 forms the suction space 101 together with the main housing 110.

The lower housing 120 includes a first lower housing 121 and a second lower housing 122. The first lower housing 121 and the second lower housing 122 form a wall surface that guides the foreign substances such as dust in the suction space 101 toward the entrance 111 between the rotating brush 310 and the entrance 111. A pair of first wheels W1 is mounted on the second lower housing 122.

The mounting housing 130 is rotatably coupled to the connector 400. A cover part 131 of the mounting housing 130 is mounted on the upper portion of the body housing 110.

The supporting housing 140 supports lower portions of the suction nozzle 10 and the connector 400. A second wheel W2 is mounted on the supporting housing 140. The second wheel W2 and the pair of first wheels W1 rotate together so as to roll on the floor.

The connector 400 is configured such that the main body 20 and the suction nozzle 10 rotate relative to each other. In addition, the connector 400 forms a passage 401 through which the suctioned up dust moves to the body 20.

The connector 400 includes an insertion part 410, a first connection part 420, a second connection part 430, a coupling part 440, and a stretchable pipe 450.

When the cover part 131 is mounted on the upper portion of the body housing 110, the insertion part 410 is inserted into the entrance 111.

The coupling part 440 rotatably connects the mounting housing 130 and the connector 400 such that they are capable of rotating about the insertion part 410.

The first connection part 420 and the second connection part 430 each have a pipe shape. The first connection part 420 and the second connection part 430 are rotatably coupled to each other.

A release button 431 is provided on the second connection part 430. The release button 431 is connected to a clasper 432. The movement of the extending pipe 30 is prevented by the clasper 432.

As illustrated in FIG. 5, the stretchable pipe 450 forms the passage 401 between the entrance 111 and the second connection part 430. The stretchable pipe 450 includes a stretchable tube 451 and a coil spring 452.

The stretchable tube 451 has the passage 401 therein. The stretchable tube 451 has a cylindrical shape. The stretchable tube 451 is made of a soft resin.

Accordingly, the stretchable tube 451 is elastically deformed when the first connection part 420 and the second connection part 430 rotate relative to each other and when the mounting housing 130 and the first connection part 420 rotate relative to each other.

The coil spring 452 is attached to an inner or outer surface of the stretchable tube 451. The coil spring 452 allows the stretchable tube 451 to maintain a cylindrical shape.

As illustrated in FIGS. 4 and 5, the driver 200 is configured to rotate the rotating brush 310. The driver 200 is coupled to one surface (hereinafter referred to as a "left surface") of the body housing 110.

The side cover 150 covers the driver 200. The side cover 150 is coupled to the left surface of the housing 100 by a clasper structure such as a hook. A hole through which air enters and exits is formed in the side cover 150.

The driver 200 includes a bracket 210, a motor 220, and a transmission device 230.

The bracket 210 is bolted to the body housing 110. The motor 220 is configured to generate a rotating force. The motor 220 may be provided as a brushless direct current (BLDC) motor. The motor 220 is coupled to the bracket 210.

The transmission device 230 is configured to transmit rotational motion of the motor 220 to the rotating brush 310. The transmission device 230 is mounted on the bracket 210. The transmission device 230 may be provided as a belt transmission device.

As illustrated in FIG. 4, the first shaft member 231 is configured to transmit rotational motion of the belt transmission device to the rotating brush 310. The second shaft member 313 is provided on one side of the rotating brush 310 in a direction of a rotational axis of the rotating brush 310.

The first shaft member 231 and the second shaft member 313 have a plurality of surfaces that engage with one another. When the first shaft member 231 and the second shaft member 313 engage with each other, a rotation axis of the first shaft member 231 and a rotation axis of the second shaft member 313 are collinear. Both a body 311 (see FIG. 5) And a rotation axis of the third shaft member 314 (see FIG. 5) are collinear. Hereinafter, it will be understood that the term "rotation axis" refers to the rotation axis of the body 311.

A rotating force of the first shaft member 231 is transmitted to the second shaft member 313 through a contact surface between the first shaft member 231 and the second shaft member 313. In a state in which the first shaft member 231 and the second shaft member 313 are engaged with each other, the rotation axis of the rotating brush 310 and the rotation axis of the first shaft member 231 are collinear.

Figure 6:
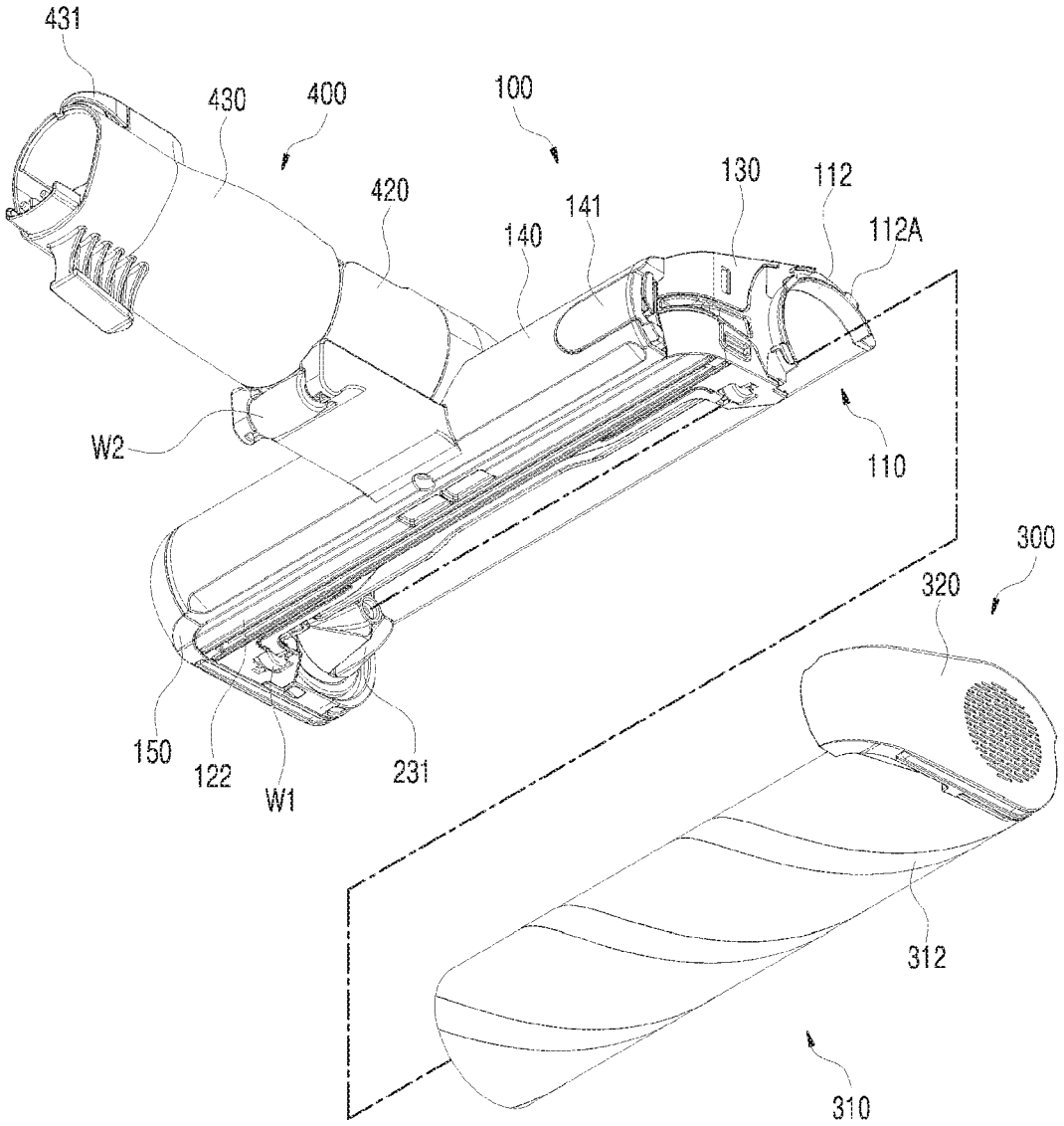
FIG. 6 is a perspective view illustrating a state in which a brush module is separated from the suction nozzle illustrated in FIG. 2, consistent with embodiments of the present disclosure.
Figure 7:
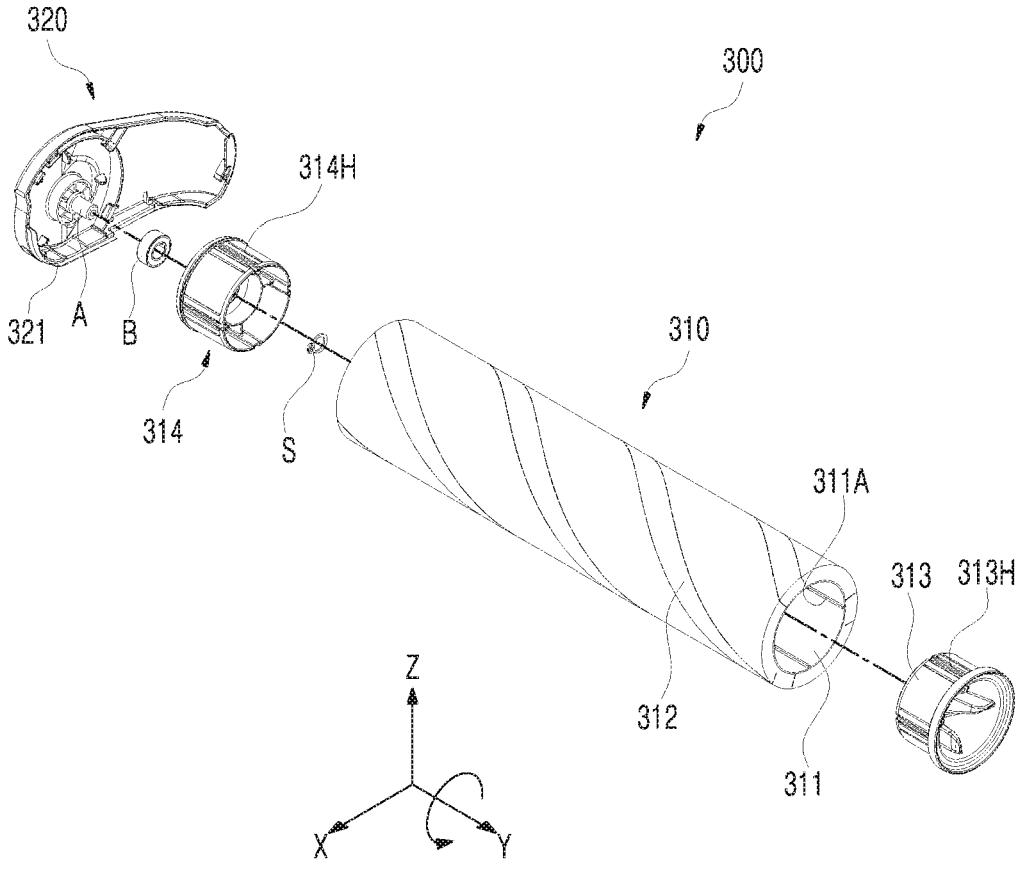
FIG. 7 is an exploded perspective view of the brush module illustrated in FIG. 6, consistent with embodiments of the present disclosure.

FIG. 6 is a perspective view illustrating a state in which the brush module 300 is separated from the suction nozzle 10 illustrated in FIG. 2. FIG. 7 is an exploded perspective view of the brush module 300 illustrated in FIG. 6.

As illustrated in FIGS. 6 and 7, the brush module 300 includes the rotating brush 310 and the detachable cover 320.

The rotating brush 310 pushes the foreign substances such as dust on the floor to the rear thereof. The rotating brush 310 includes the body 311, a brush member 312, the second shaft member 313, and the third shaft member 314.

The body 311 forms a skeleton of the rotating brush 310. The body 311 has a hollow cylindrical shape. A central axis of the body 311 acts as a central axis of the rotating brush 310. The body 311 maintains a uniform rotational inertia along a circumferential direction thereof. The body 311 may be made of a synthetic resin or a metal material.

The brush member 312 is attached to an outer surface of the body 311. The brush member 312 includes a plurality of filaments. As the body 311 rotates, the plurality of filaments are elastically deformed due to friction with the floor and push the foreign substances on the floor toward the entrance. Although not shown, a fiber layer is attached to the outer surface of the body 311, and the plurality of filaments may be attached to the fiber layer.

The second shaft member 313 is configured to receive rotational motion of the first shaft member 231. The second shaft member 313 is inserted into one side opening of the body 311.

An insertion groove 313H is formed in the outer surface of the second shaft member 313. A protrusion 311A is formed on an inner surface of the body 311 along a longitudinal direction of the body 311. When the second shaft member 313 is inserted into the opening of the body 311, the protrusion 311A is inserted into the insertion groove 313H. The protrusion 311A prevents relative rotation of the second shaft member 313.

The second shaft member 313 provides a space into which the first shaft member 231 is inserted. The first shaft member 231 is axially inserted into the second shaft member 313.

The first shaft member 231 and the second shaft member 313 have a plurality of surfaces that engage with one another. When the first shaft member 231 and the second shaft member 313 engage with each other, the rotation axis of the first shaft member 231 and the rotation axis of the second shaft member 313 are collinear.

The rotating force of the first shaft member 231 is transmitted to the second shaft member 313 through a contact surface between the first shaft member 231 and the second shaft member 313. In a state in which the first shaft member 231 and the second shaft member 313 are engaged with each other, the rotation axis of the rotating brush 310 and the rotation axis of the first shaft member 231 are collinear.

The third shaft member 314 is configured to rotatably connect the body 311 to the detachable cover 320. The third shaft member 314 is inserted into one side opening of the body 311 and is disposed on an opposite side from second shaft member 313. The third shaft member 314 is inserted into the other side opening of the body 311.

An insertion groove 314H is formed in the outer surface of the third shaft member 314. The protrusion 311A is formed on the inner surface of the body 311 along the longitudinal direction of the body 311. When the third shaft member 314 is inserted into the opening of the body 311, the protrusion 311A is inserted into the insertion groove 314H. The protrusion 311A prevents relative rotation of the third shaft member 314.

A bearing B is mounted on the third shaft member 314. A fixed shaft A is provided on the detachable cover 320. The bearing B is configured to rotatably support the fixed shaft A. A groove is formed in the fixed shaft A. A snap ring S is mounted in the groove so as to prevent the fixed shaft A and the third shaft member 314 from being separated from each other.

Figure 8:
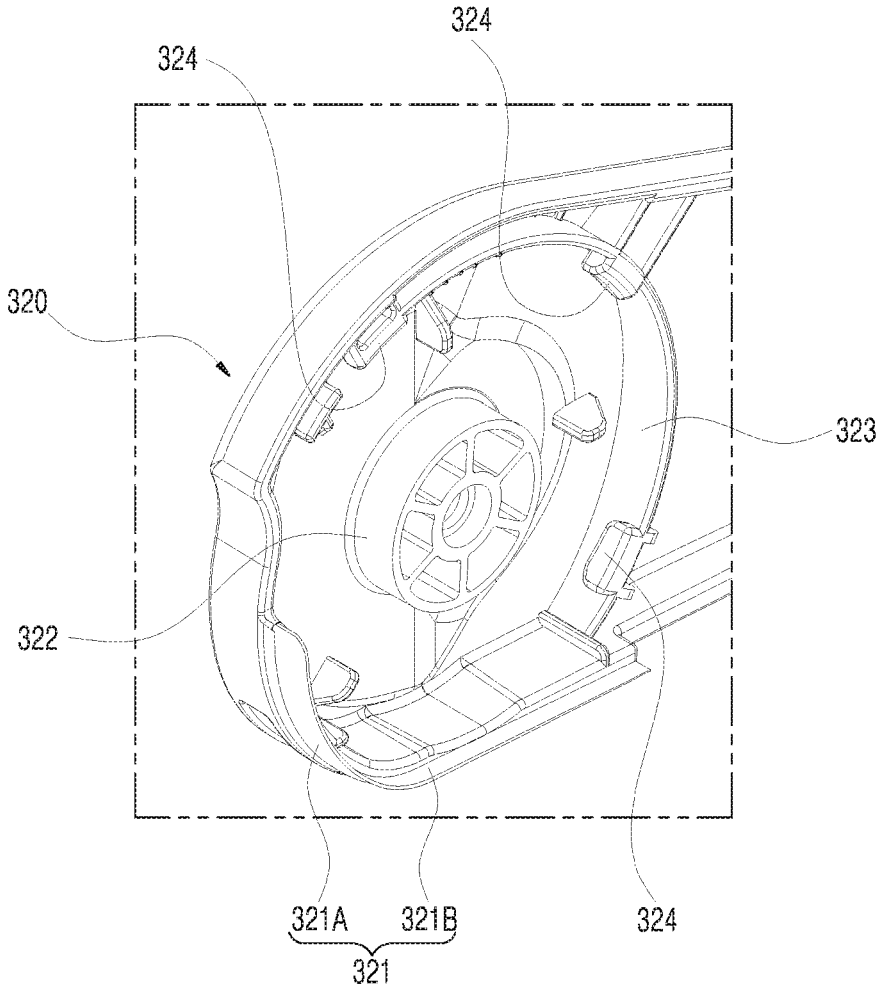
FIG. 8 is a partial perspective view illustrating a detachable cover illustrated in FIG. 7, consistent with embodiments of the present disclosure.

FIG. 8 is a partial perspective view illustrating the detachable cover 320 illustrated in FIG. 7.

As illustrated in FIG. 8, the detachable cover 320 rotatably supports the rotating brush 310 on the opposite side of the first shaft member 231. A hub 322, a protruding rib 323, and first projections 324 are formed in the detachable cover 320.

The hub 322 is a part to which the fixed shaft A is coupled. The fixed shaft A may be inserted into the mold when the detachable cover 320 is injection molded. The hub 322 is formed on the inner surface of the detachable cover 320. Here, the inner surface denotes a surface facing the housing 100.

The protruding rib 323 is configured to space the first projections 324 by a predetermined distance from the inner surface of the detachable cover 320. The protruding rib 323 is formed on the inner surface of the detachable cover 320. The protruding rib 323 is formed along a circumferential direction of the hub 322 around the hub 322.

A plurality of first projections 324 are provided on the protruding rib 323. The first projections 324 protrude from the protruding rib 323 toward the hub 322. The first projections 324 are disposed to be spaced apart from each other along a circumferential direction of the fixed shaft A around the fixed shaft A.

The first projections 324 maintain a predetermined distance from the inner surface of the detachable cover 320 by the protruding rib 323. The first projections 324 may be guided by an outer surface of a guide rail 112 (see FIG. 6) so as to rotate in both directions.

As illustrated in FIG. 6, the guide rail 112 and a plurality of first wall parts 112A are formed on one surface (hereinafter referred to as a "right surface") of the body housing 110.

The guide rail 112 is formed on the right surface of the body housing 110. The guide rail 112 is formed along the circumferential direction of the first shaft member 231 around the rotation axis of the first shaft member 231.

The outer surface of the guide rail 112 guides rotation of the first projections 324 about the rotation axis of the first shaft member 231 during assembly. The first projections 324 may be guided by the outer surface of the guide rail 112 such that the first projections 324 are rotated in both directions about the rotation axis.

The first wall parts 112A are formed on the outer surface of the guide rail 112. The first wall parts 112A protrude from the outer surface of the guide rail 112. The first projections 324 may be rotated to enter between the first wall parts 112A and the body housing 110 during assembly. In such a case, the first wall parts 112A prevent axial movement of the first projections 324. In addition, the first wall parts 112A prevent the first projections 324 from rotating in one direction.

As illustrated in FIG. 6, a push button 141 is mounted on the supporting housing 140. The push button 141 selectively prevents rotation of the detachable cover 320. Accordingly, the detachable cover 320 may be detachably coupled to the housing 100 so as to rotate about the rotation axis of the rotating brush 310.

Figure 9:
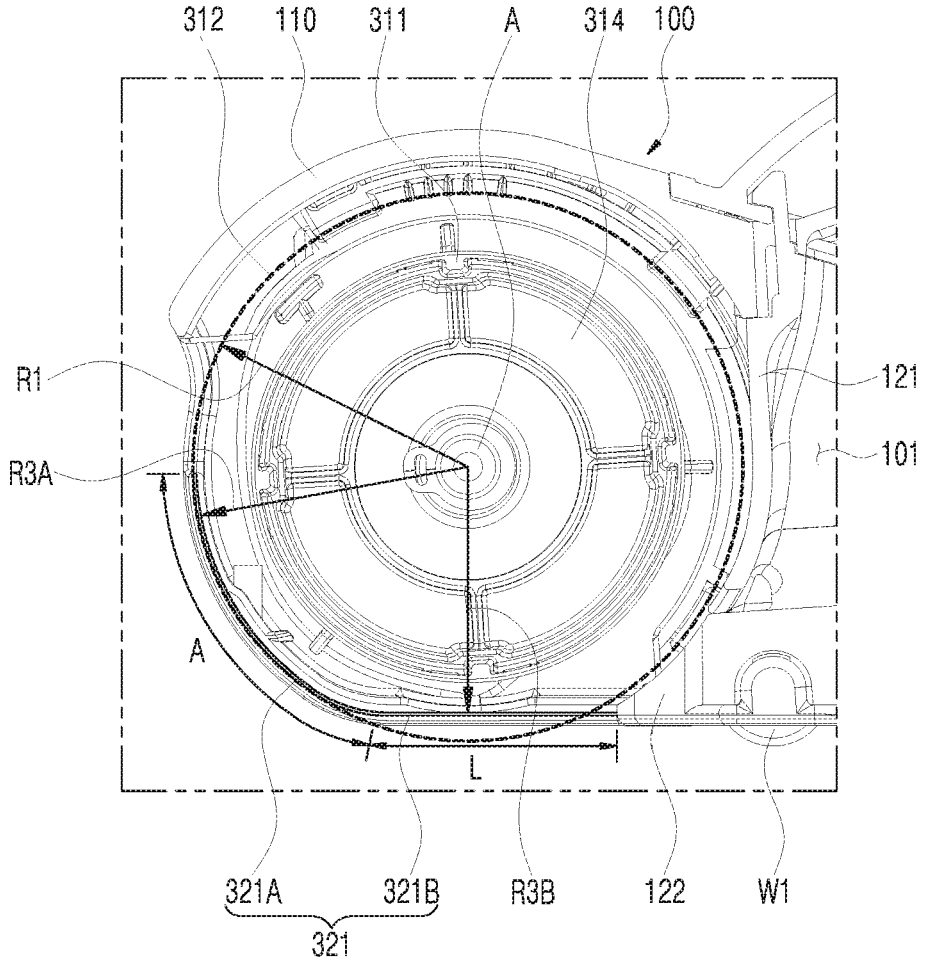
FIG. 9 is a partial cross-sectional view illustrating a second rib of the suction nozzle illustrated in FIG. 2, consistent with embodiments of the present disclosure.

FIG. 9 is a partial cross-sectional view illustrating a second rib 321 of the suction nozzle 10 illustrated in FIG. 2.

As illustrated in FIGS. 8 and 9, the second rib 321 is formed on the detachable cover 320.

The second rib 321 protrudes from the inner surface of the detachable cover 320 in the direction of the rotation axis of the body 311 so as to come into contact with the brush member 312. The second rib 321 is interposed between the detachable cover 320 and the brush member 312 such that a gap between the detachable cover 320 and the brush member 312 is blocked.

The second rib 321 includes a second A rib 321A and a second B rib 321B. The second A rib 321A and the second B rib 321B are connected to each other.

The second A rib 321A is formed in front of the rotation axis. The second A rib 321A comes into contact with the filaments in front of the rotation axis. The second A rib 321A is at a distance R3A from the rotation axis of the body 311. The second A rib 321A is formed along the circumferential direction of the body 311 around the rotation axis of the body 311.

The radius R1 of the outermost portion of the brush member 312 centered on the rotation axis of the body 311 is greater than the distance R3A between the rotation axis of the body 311 and the second A rib 321A. Accordingly, even when the rotating brush 310 rotates, the second A rib 321A and the brush member 312 are in continuous contact with each other.

In FIG. 9, A denotes a region in which the second A rib 321A is formed along the circumferential direction around the rotation axis. Foreign substances such as hair dropped on the floor may extend to a certain height from the floor. Accordingly, it is advantageous for the height of the region A to be higher than that of the foreign substances such as hair.

As described above, the body housing 110 covers the upper portion of the rotating brush 310 along the circumferential direction of the rotating brush 310. In addition, the detachable cover 320 is detachably coupled to the housing 100 so as to rotate about the rotation axis of the rotating brush 310. Accordingly, the uppermost end of the region A may be spaced apart from the body housing 110 by a rotation angle of the detachable cover 320.

The second B rib 321B is provided below the rotation axis. The second B rib 321B comes into contact with the filaments under the rotation axis of the rotating brush 310. The second B rib 321B is parallel to the floor. The second B rib 321B is formed at a predetermined distance from the floor. Accordingly, the second B rib 321B is at the shortest distance R3B from the central axis of the body 311 at a position directly below the central axis of the body 311.

In FIG. 9, L denotes a region in which the second B rib 321B is provided in a straight line shape. At the point where the second A rib 321A and the second B rib 321B are connected to each other, a distance between the second B rib 321B and the rotation axis of the body 311 is the same as the distance R3A.

As described above, the radius R1 of the outermost portion of the brush member 312 centered on the rotation axis of the body 311 is greater than the distance R3A between the rotation axis of the body 311 and the second A rib 321A.

In addition, the greatest distance between the second B rib 321B and the rotation axis of the body 311 is the distance R3A. Accordingly, even when the rotating brush 310 rotates, the second B rib 321B and the brush member 312 are in continuous contact with each other.

Figure 10:
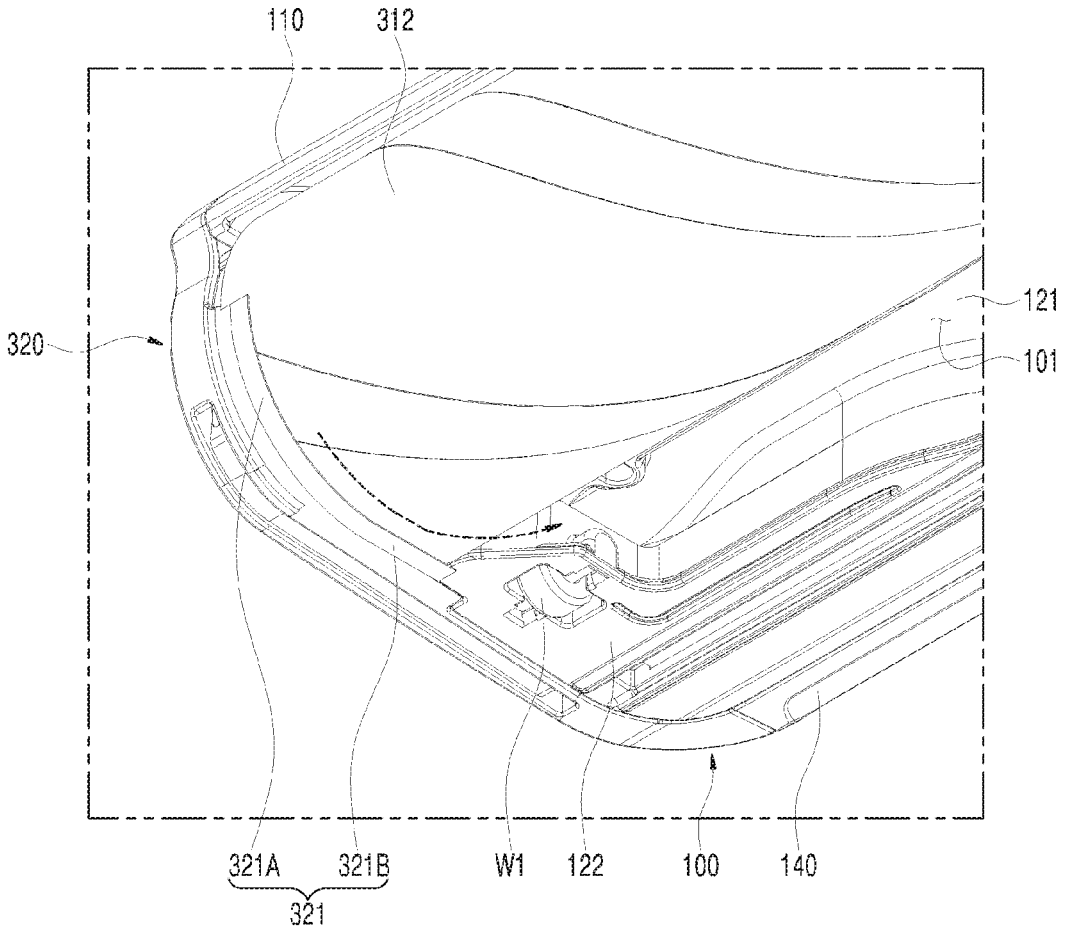
FIG. 10 is a partial perspective view of the second rib of the suction nozzle illustrated in FIG. 2, as viewed from below, consistent with embodiments of the present disclosure.

FIG. 10 is a partial perspective view of the second rib 321 of the suction nozzle 10 illustrated in FIG. 2, as viewed from below.

As illustrated in FIG. 10, the second rib 321 is interposed between the detachable cover 320 and the brush member 312 such that the gap between the detachable cover 320 and the brush member 312 is blocked. Accordingly, it is possible to prevent foreign substances such as dust and hair on the floor from entering between the detachable cover 320 and the brush member 312.

As the rotating brush 310 rotates, the foreign substances adhering to the brush member 312 may be pushed along an inclined surface of the second lower housing 122, thereby moving toward the suction space 101.

The foreign substances such as dust moved to the suction space 101 enter the passage 401 through the entrance 111. A dotted line in FIG. 10 represents a path in which the foreign substances adhering to the brush member 312 move toward the suction space 101.

Figure 11:
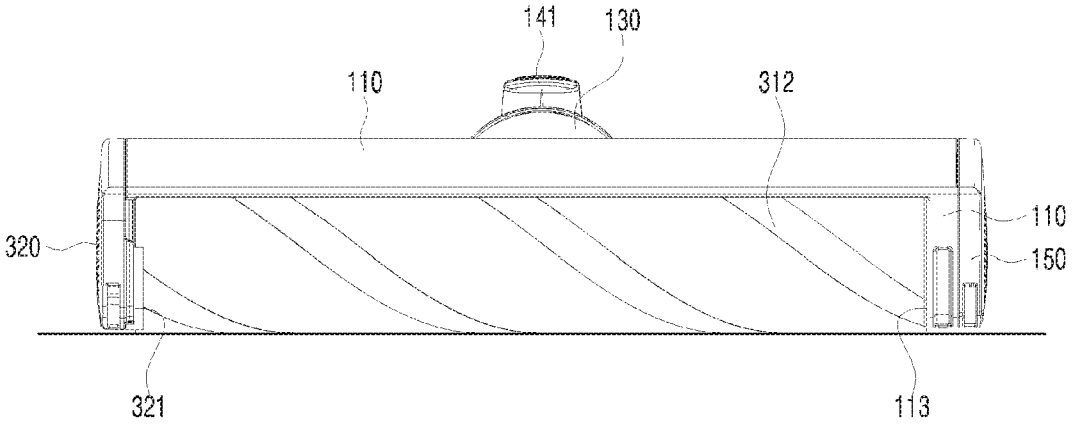
FIG. 11 is a front view of the suction nozzle illustrated in FIG. 2, consistent with embodiments of the present disclosure.
Figure 12:
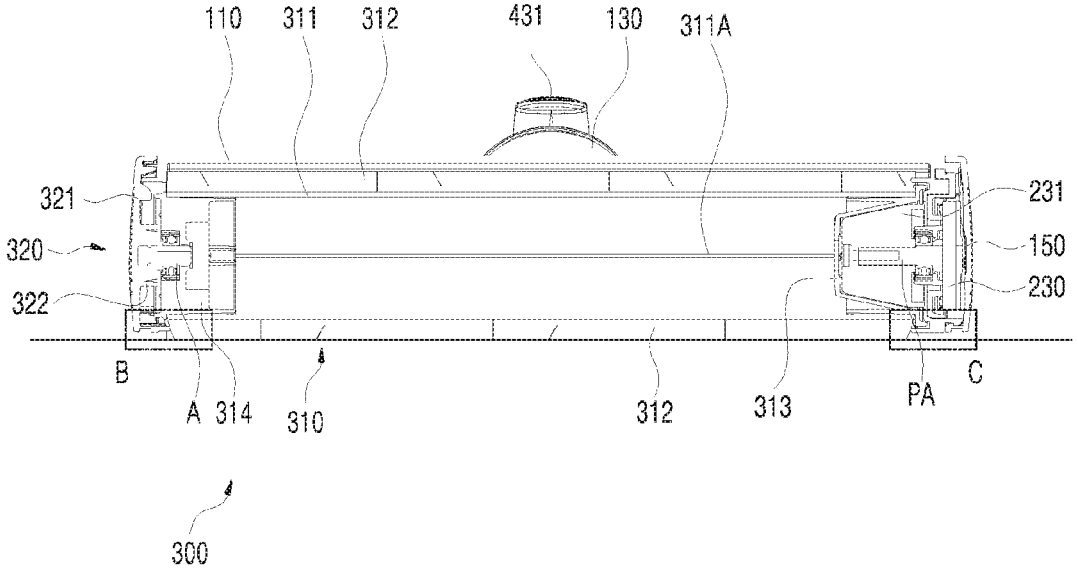
FIG. 12 is a cross-sectional view of the suction nozzle illustrated in FIG. 11, consistent with embodiments of the present disclosure.

FIG. 11 is a front view of the suction nozzle 10 illustrated in FIG. 2. FIG. 12 is a cross-sectional view of the suction nozzle 10 illustrated in FIG. 11.

As illustrated in FIGS. 11 and 12, when the vacuum cleaner 1 is operated, a lower portion of the brush member 312 comes into contact with the floor. In such a case, the housing 100 and the detachable cover 320 are separated from the floor.

Figure 13:
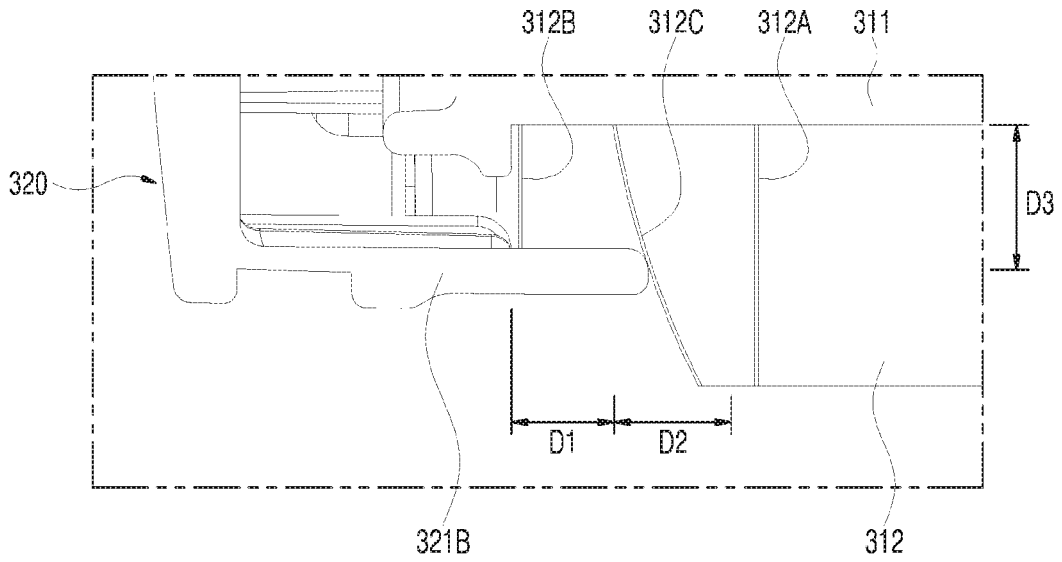
FIG. 13 is an enlarged view of a portion B illustrated in FIG. 12, consistent with embodiments of the present disclosure.

FIG. 13 is an enlarged view of a portion B illustrated in FIG. 12.

As illustrated in FIG. 13, the plurality of filaments are formed of a soft material (flannel) that is easily elastically deformed by an external force. The plurality of filaments may be classified into a first filament 312A, a second filament 312B, and a third filament 312C according to a shape of elastic deformation thereof. The first filament 312A, the second filament 312B, and the third filament 3120 are each formed in plural number.

The first filaments 312A are spaced apart from the second rib 321.

The first filaments 312A are not elastically deformed by the second rib 321. The first filaments 312A are elastically deformed only by friction with the floor when the body 311 rotates. The first filaments 312A may be elastically deformed, thereby pushing the foreign substances on the floor toward the entrance 111.

In FIG. 13, only one first filament 312A is shown. It should be understood that the first filaments 312A are densely present in a region excluding a region D1 and a region D2.

The second filaments 312B are interposed between the outer surface of the body 311 and the second rib 321.

When the body 311 is rotatably connected to the detachable cover 320, the second filaments 312B may be interposed between the outer surface of the body 311 and the second rib 321. The second filaments 312B are elastically deformed by friction with the second rib 321 when the body 311 rotates.

In FIG. 13, the region D1 represents a region in which the second filaments 312B are located. As a length of the second rib 321 protruding in the direction of the rotation axis increases, a length of the region D1 increases. That is, the length of the region D1 increases in direct proportion to a length by which the second rib 321 protrudes.

In FIG. 13, only one second filament 312B is shown. It should be understood that the second filaments 312B are densely present in the region D1.

As illustrated in FIG. 13, the second rib 321 is closer to the outer surface of the body 311 than the floor. That is, a distance between the outer surface of the body 311 and the floor is greater than a distance between the outer surface of the body 311 and the second rib 321. Accordingly, when the body 311 rotates, an amount of elastic deformation of the second filaments 312B is greater than an amount of elastic deformation of the first filaments 312A.

The bulk density denotes a density of filaments occupying a filling space such as a fiber body. Thus, bulk density may be understood as the fraction of the filling space occupied by the fiber body of the filaments. An amount of elastic deformation of the filaments attached to the body 311 caused by any object is proportional to a distance between the body 311 and the object.

The closer the distance between the body 311 and the object, that is, the more the filaments are pressed by the object, the greater the amount of elastic deformation of the filaments. Because of the deformation of second filaments 312B, more of the fiber body of the second filaments occupies the filling space between body 311 and second rib 321. Accordingly, the second filaments 312B have a higher bulk density than the first filaments 312A.

The third filaments 312C are elastically deformed in the direction of the rotation axis by being pushed by the second rib 321.

When the body 311 is rotatably connected to the detachable cover 320, the third filaments 312C may be pushed in the direction of the rotation axis by the second rib 321. In addition, the third filaments 312C may be more elastically deformed by friction with the floor when the body 311 rotates.

In FIG. 13, the region D2 denotes a region in which the third filaments 312C are located. When the region D1 exists, the length of the region D2 is constant regardless of the length by which the second rib 321 protrudes in the direction of the rotation axis.

Figure 14:
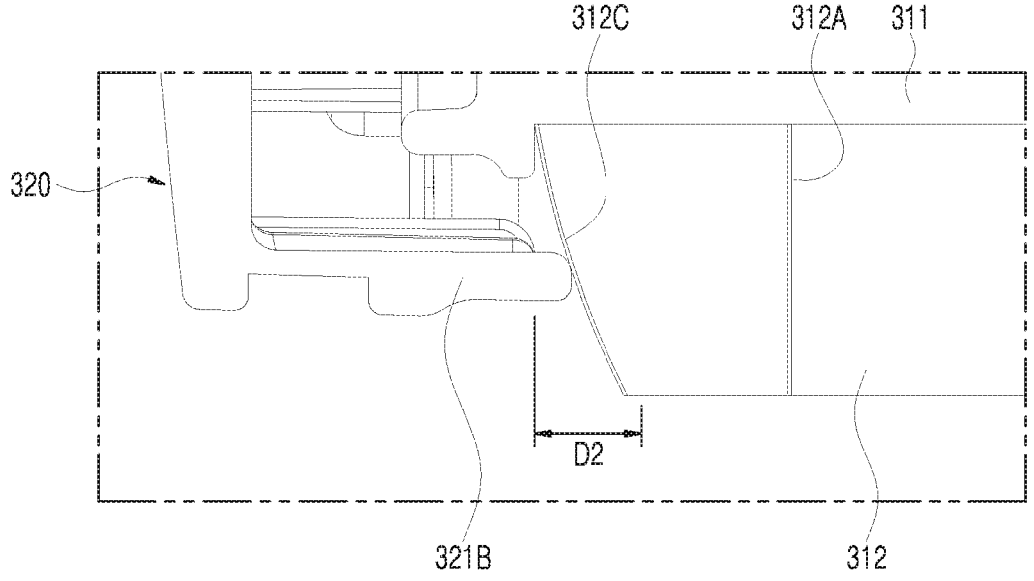
FIG. 14 is an enlarged view of another embodiment of the portion B illustrated in FIG. 12, consistent with embodiments of the present disclosure.

FIG. 14 is an enlarged view of another embodiment of the portion B illustrated in FIG. 12. FIG. 14 illustrates a case where the region D1 does not exist. When the length of the second rib 321 protruding in the direction of the rotation axis is short, the region D1 may not exist.

As illustrated in FIG. 14, when the region D1 does not exist, the length of the region D2 increases in proportion to the length by which the second rib 321 protrudes in the direction of the rotation axis. That is, when the region D1 does not exist, the length of the region D2 increases in direct proportion to the length by which the second rib 321 protrudes.

In FIGS. 13 and 14, only one third filament 312C is shown. It should be understood that the third filaments 312C are densely present in the region D2.

As illustrated in FIGS. 13 and 14, the third filaments 312C are in a state of being elastically deformed in the direction of the rotation axis by being pushed by the second rib 321 even when the body 311 is not rotated.

In addition, the third filaments 312C may be more elastically deformed by friction with the floor when the body 311 rotates. Accordingly, when the body 311 rotates, a total amount of elastic deformation of the third filaments 312C may be greater than an amount of elastic deformation of the first filaments 312A.

The third filaments 312C are closer to each other by being pushed by the second rib 321 even when the body 311 is not rotated. Because the third filaments are closer to each other, their bulk density increases and the closer the third filaments are to each other the more their bulk density increases. Accordingly, the third filaments 312C have a higher bulk density than the first filaments 312A.

As described above, the second filaments 312B and the third filaments 312C have a higher bulk density than the first filaments 312A in the region occupied by second rib 321. Accordingly, the risk of foreign substances such as dust and hair on the floor passing through the filaments and then moving toward the third shaft member 314 is eliminated.

As described above, the second B rib 321B is formed at a predetermined distance from the floor. Accordingly, the second B rib 321B is at the shortest distance R3B from the central axis of the body 311 at the position directly below the central axis of the body 311.

In addition, a distance between the central axis of the body 311 and the second B rib 321B gradually increases as the second B rib 321B moves away from the position directly below the central axis of the body 311.

The shorter the distance D3 between the second rib 321 and the outer surface of the body 311, the greater the amount of elastic deformation of the second filaments 312B. Accordingly, the bulk density of the second filaments 312B increases.

In addition, the shorter the distance D3 between the second rib 321 and the outer surface of the body 311, the more the number of the third filaments 312C that are elastically deformed increases. That is, the shorter the distance D3 between the second rib 321 and the outer surface of the body 311, the more the bulk density of the third filaments 312C increases. Accordingly, the second filaments 312B and the third filaments 312C increase in bulk density as they go toward a direction directly downward of the rotation axis.

The foreign substances such as hair and dust ① may enter the first shaft member 231 and the third shaft member 314 from the floor between the filaments and the housing 100 and between the filaments and the detachable cover 320, or ② may move to the ends of the rotating brush 310 along the grain of the filaments while adhering to the filaments, and then enter the first shaft member 231 and the third shaft member 314.

① is limited to occurring in the lower portion of the rotating brush 310. ② occurs constantly along the circumferential direction of the rotating brush 310. Accordingly, the foreign substances such as hair and dust mainly enter the first shaft member 231 and the third shaft member 314 from the lower portion of the rotating brush 310.

In the vacuum cleaner 1 according to an embodiment of the present disclosure, since the second filaments 312B and the third filaments 312C increase in bulk density as they go toward the direction directly downward of the rotation axis, it is possible to reliably prevent the foreign substances such as hair and dust from penetrating from the lower portion of the rotating brush 310 through which the foreign substances mainly penetrate.

Figure 15:
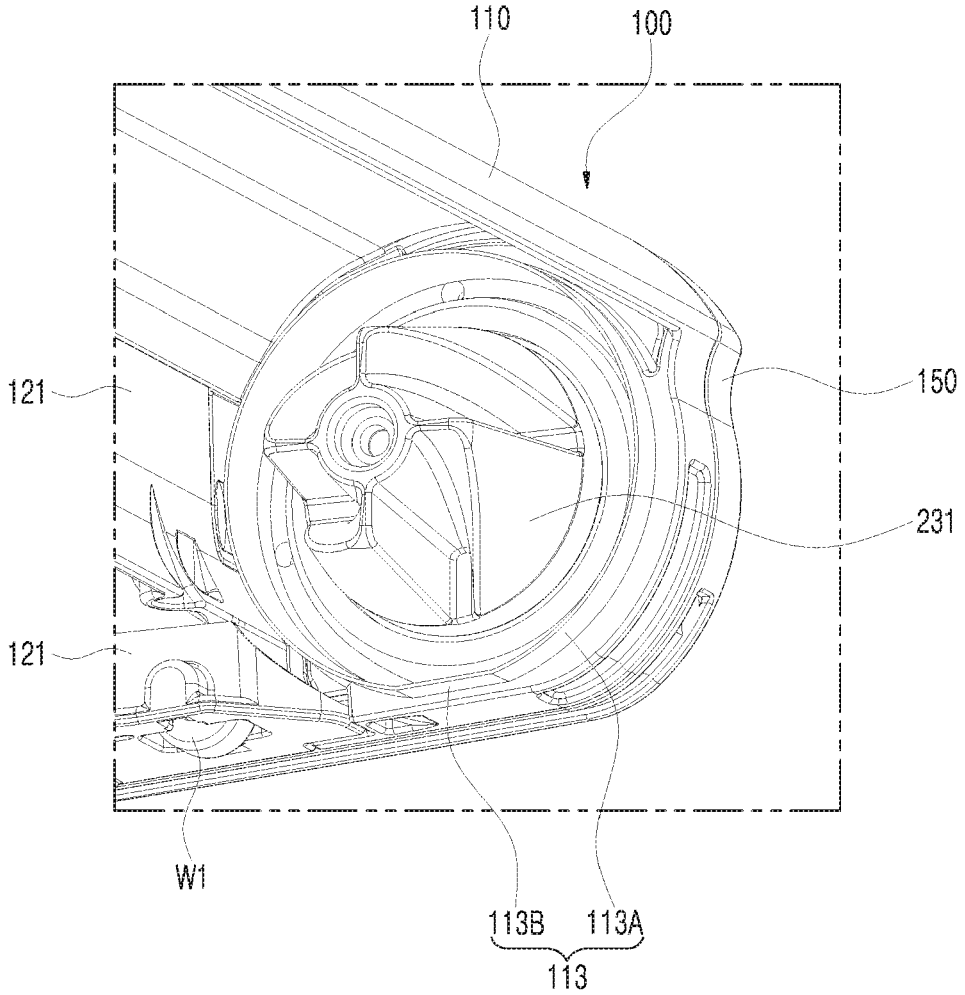
FIG. 15 is a partial perspective view illustrating a first shaft member of the suction nozzle illustrated in FIG. 6, consistent with embodiments of the present disclosure.
Figure 16:
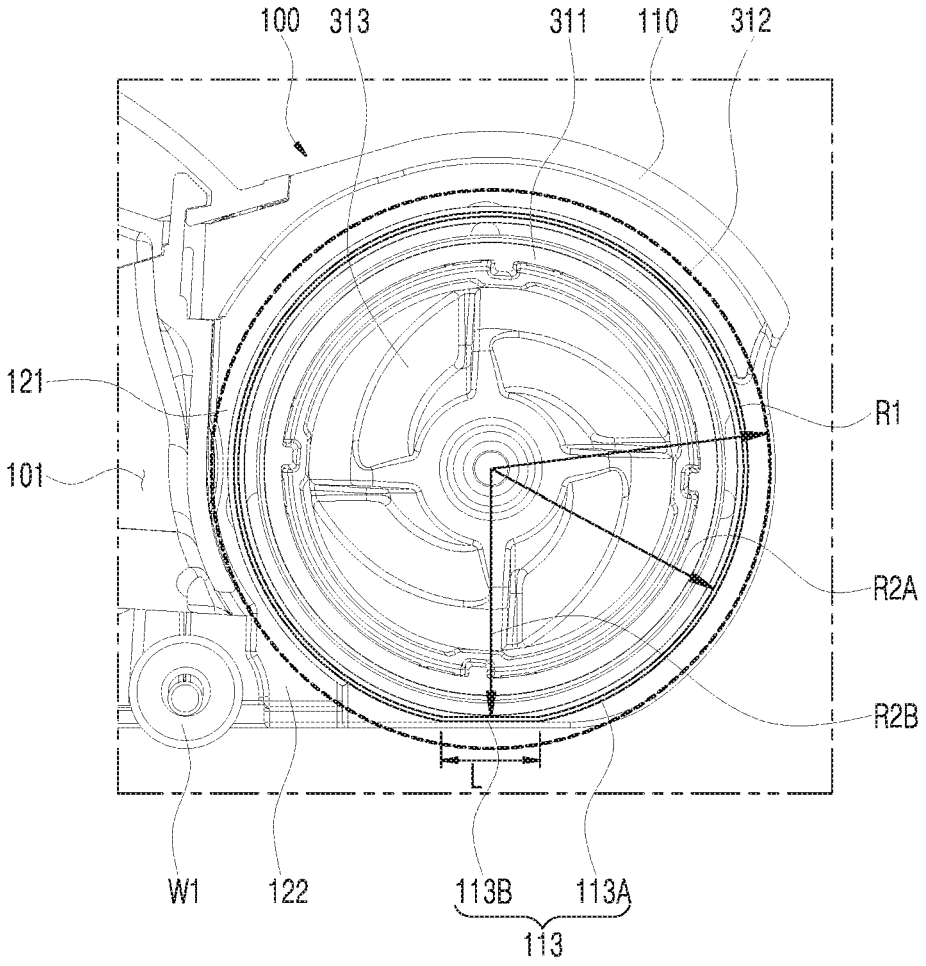
FIG. 16 is a partial cross-sectional view illustrating a first rib of the suction nozzle illustrated in FIG. 2, consistent with embodiments of the present disclosure.

FIG. 15 is a partial cross-sectional view illustrating the first shaft member 231 of the suction nozzle 10 illustrated in FIG. 6. FIG. 16 is a partial cross-sectional view illustrating the first rib 113 of the suction nozzle 10 illustrated in FIG. 2.

As illustrated in FIGS. 15 and 16, the first rib 113 is formed in the housing 100. The first rib 113 protrudes from the housing 100 in the direction of the rotation axis of the body 311 so as to come into contact with the brush member 312.

The first rib 113 is disposed along the circumference of the first shaft member 231. The first rib 113 is interposed between the housing 100 and the brush member 312 such that a gap between the housing 100 and the brush member 312 is blocked.

The first rib 113 includes a first A rib 113A and a first B rib 113B. The first A rib 113A and the first B rib 113B are connected to each other. The first A rib 113A and the first B rib 113B have a shape surrounding the circumference of the first shaft member 231.

As illustrated in FIG. 16, the first A rib 113A is at a distance R2A from the rotation axis of the body 311. The first A rib 113A is formed along the circumferential direction around the rotation axis of the body 311.

The radius R1 of the outermost portion of the brush member 312 centered on the rotation axis of the body 311 is greater than the distance R2A between the rotation axis of the body 311 and the first A rib 113A. Accordingly, even when the rotating brush 310 rotates, the first A rib 113A and the brush member 312 are in continuous contact with each other.

The first B rib 113B is provided below the rotation axis. The first B rib 113B comes into contact with the filaments under the rotation axis. The first B rib 113B is formed at a predetermined distance from the floor. The first B rib 113B is parallel to the floor. Accordingly, the first B rib 113B is at the shortest distance R2B from the central axis of the body 311 at the position directly below the central axis of the body 311.

In FIG. 16, L denotes a region in which the first B rib 113B is provided in a straight line shape. At a point where the first A rib 113A and the first B rib 113B are connected to each other, a distance between the first B rib 113B and the rotation axis of the body 311 is the same as the distance R2A.

As described above, the radius R1 of the outermost portion of the brush member 312 centered on the rotation axis of the body 311 is greater than the distance R2A between the rotation axis of the body 311 and the first A rib 113A. In addition, the greatest distance between the first B rib 113B and the rotation axis of the body 311 is the distance R2A. Accordingly, even when the rotating brush 310 rotates, the first B rib 113B and the brush member 312 are in continuous contact with each other.

Figure 17:
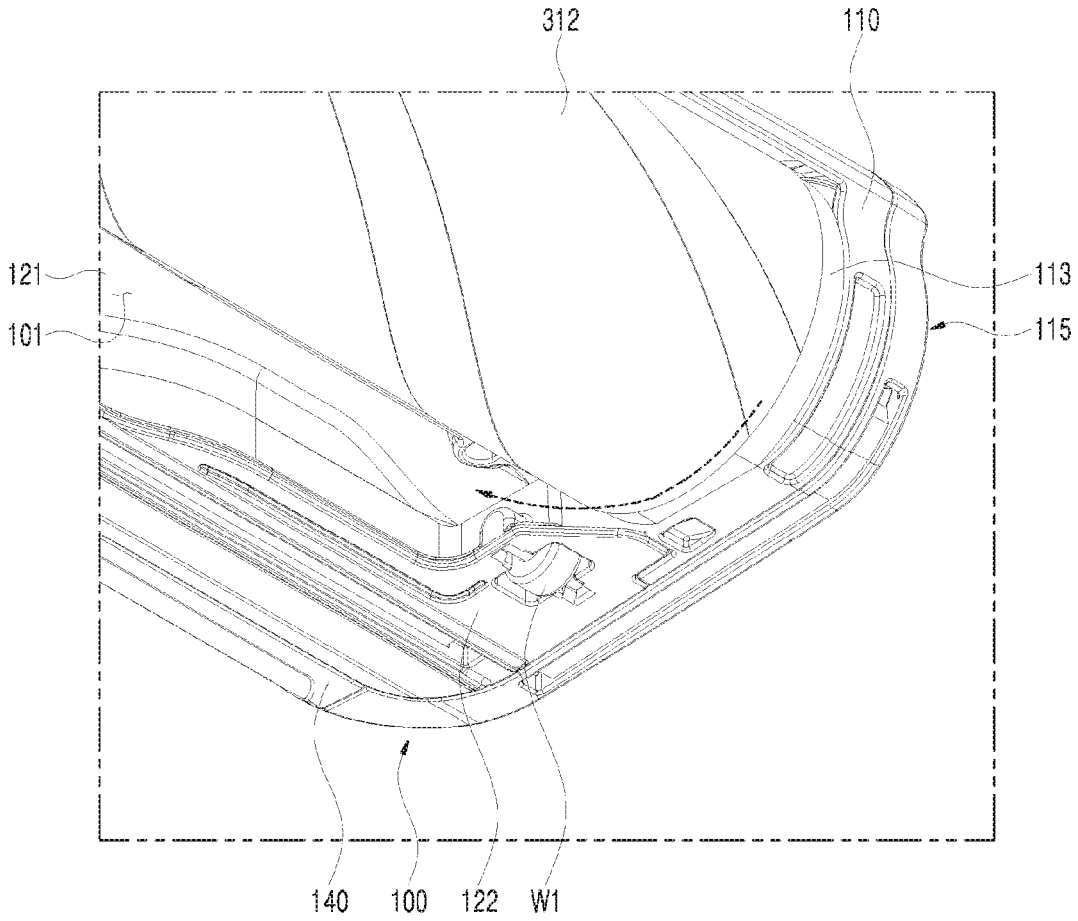
FIG. 17 is a partial perspective view of the first rib of the suction nozzle illustrated in FIG. 2, as viewed from below, consistent with embodiments of the present disclosure.

FIG. 17 is a partial perspective view of the first rib 113 of the suction nozzle 10 illustrated in FIG. 2, as viewed from below.

As illustrated in FIG. 17, the first rib 113 is interposed between the housing 100 and the brush member 312 such that the gap between the housing 100 and the brush member 312 is blocked.

The first A rib 113A and the first B rib 113B have a shape surrounding the circumference of the first shaft member 231. Accordingly, it is possible to prevent the foreign substances such as dust and hair from entering between the housing 100 and the brush member 312.

As the rotating brush 310 rotates, the foreign substances adhering to the brush member 312 may be pushed along the inclined surface of the second lower housing 122, thereby moving toward the suction space 101. The foreign substances such as dust moved to the suction space 101 enter the passage 401 through the entrance 111. A dotted line in FIG. 17 represents a path in which foreign substances adhering to the brush member 312 move toward the suction space 101.

Figure 18:
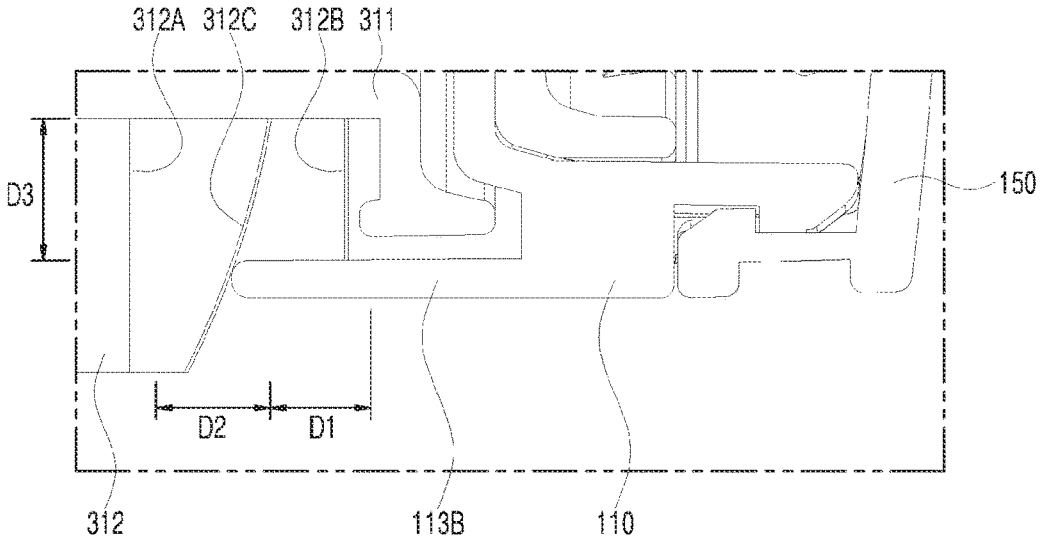
FIG. 18 is an enlarged view of a portion C illustrated in FIG. 12, consistent with embodiments of the present disclosure.

FIG. 18 is an enlarged view of a portion C illustrated in FIG. 12.

As illustrated in FIG. 18, the plurality of filaments are formed of the soft material (flannel) that is easily elastically deformed by the external force. The plurality of filaments may be classified into first filaments 312A, second filaments 312B, and third filaments 312C according to a shape of elastic deformation thereof. The first filaments 312A, the second filaments 312B, and the third filaments 312C may each be formed in plural number.

The first filaments 312A are spaced apart from the first rib 113. The first filaments 312A are not elastically deformed by the first rib 113. The first filaments 312A are elastically deformed only by friction with the floor when the body 311 rotates. The first filaments 312A may be elastically deformed, thereby pushing the foreign substances on the floor toward the entrance 111.

In FIG. 18, only one first filament 312A is shown. It should be understood that the first filaments 312A are densely present in a region excluding the region D1 and the region D2.

The second filaments 312B are interposed between the outer surface of the body 311 and the first rib 113. When the second shaft member 313 of the rotating brush 310 is fitted to the first shaft member 231, the second filaments 312B may be interposed between the outer surface of the body 311 and the first rib 113. The second filaments 312B are elastically deformed by friction with the first rib 113 when the body 311 rotates.

In FIG. 18, the region D1 denotes a region in which the second filaments 312B are located. As the length of the first rib 113 protruding in the direction of the rotation axis increases, the length of the region D1 increases. That is, the length of the region D1 increases in direct proportion to the length by which the first rib 113 protrudes. In FIG. 18, only one second filament 312B is shown. It should be understood that the second filaments 312B are densely present in the region D1.

As illustrated in FIG. 18, the first rib 113 is closer to the outer surface of the body 311 than the floor. That is, a distance between the outer surface of the body 311 and the floor is greater than a distance between the outer surface of the body 311 and the first rib 113. Accordingly, when the body 311 rotates, an amount of elastic deformation of the second filaments 312B is greater than an amount of elastic deformation of the first filaments 312A.

An amount of elastic deformation of the filaments attached to the body 311 caused by any object is proportional to the distance between the body 311 and the object.

The closer the distance between the body 311 and the object, that is, the more the filaments are pressed by the object, the greater the amount of elastic deformation of the filaments. Accordingly, the second filaments 312B have a higher bulk density than the first filaments 312A.

The third filaments 312C are elastically deformed in the direction of the rotation axis by being pushed by the first rib 113.

When the second shaft member 313 of the rotating brush 310 is fitted to the first shaft member 231, the third filaments 312C may be pushed in the direction of the rotation axis by the first rib 113. In addition, the third filaments 3120 may be more elastically deformed by friction with the floor when the body 311 rotates.

In FIG. 18, the region D2 denotes a region in which the third filaments 312C are located. When the region D1 exists, the length of the region D2 is constant regardless of the length by which the first rib 113 protrudes in the direction of the rotation axis.

Figure 19:
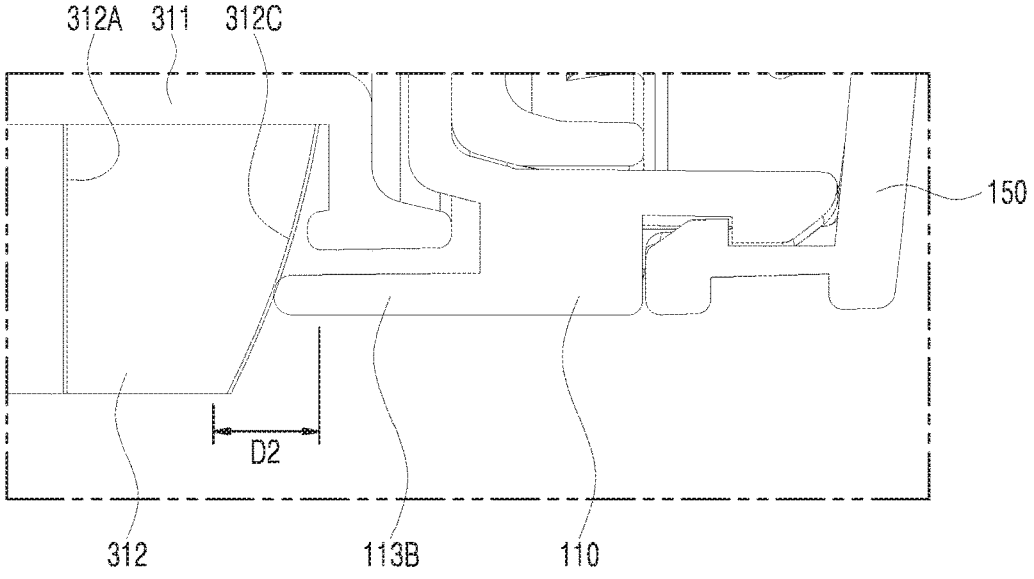
FIG. 19 is an enlarged view of another embodiment of the portion C illustrated in FIG. 12, consistent with embodiments of the present disclosure.

FIG. 19 is an enlarged view of another embodiment of the portion C illustrated in FIG. 12. FIG. 19 illustrates a case where the region does not exist. When the length of the first rib 113 protruding in the direction of the rotation axis is short, the region D1 may not exist.

As illustrated in FIG. 19, when the region D1 does not exist, the length of the region D2 increases in proportion to the length by which the first rib 113 protrudes in the direction of the rotation axis. That is, when the region D1 does not exist, the length of the region D2 increases in direct proportion to the length by which the first rib 113 protrudes.

In FIGS. 18 and 19, only one third filament 312C is shown. It should be understood that the third filaments 312C are densely present in the region D2.

As illustrated in FIGS. 18 and 19, the third filaments 312C are in a state of being elastically deformed in the direction of the rotation axis by being pushed by the first rib 113 even when the body 311 is not rotated. In addition, the third filaments 312C may be more elastically deformed by friction with the floor when the body 311 rotates.

Accordingly, when the body 311 rotates, a total amount of elastic deformation of the third filaments 312C may be greater than an amount of elastic deformation of the first filaments 312A.

The third filaments 312C are closer to each other by being pushed by the first rib 113 even when the body 311 is not rotated. The closer the filaments are to each other, the more the bulk density increases. Accordingly, the third filaments 312C have a higher bulk density than the first filaments 312A.

As described above, the second filaments 312B and the third filaments 3120 have a higher bulk density than the first filaments 312A in the region occupied by first rib 113. Accordingly, the risk of foreign substances such as dust and hair on the floor passing through the filaments and then moving toward the third shaft member 314 is eliminated.

As described above, the first B rib 113B is formed at a predetermined distance from the floor. Accordingly, the first B rib 113B is at the shortest distance R2B from the central axis of the body 311 at the position directly below the central axis of the body 311.

In addition, the distance between the central axis of the body 311 and the first B rib 113B gradually increases as the first B rib 113B moves away from the position directly below the central axis of the body 311.

The shorter the distance D3 between the first rib 113 and the outer surface of the body 311, the greater the amount of elastic deformation of the second filaments 312B. Accordingly, the bulk density of the second filaments 312B increases.

In addition, the shorter the distance D3 between the first rib 113 and the outer surface of the body 311, the more the number of the third filaments 312C that are elastically deformed increases. That is, the shorter the distance D3 between the first rib 113 and the outer surface of the body 311, the more the bulk density of the third filaments 312C increases.

The second filaments 312B and the third filaments 312C increase in bulk density as they go toward the direction directly downward of the rotation axis.

The foreign substances such as hair and dust ① may enter the first shaft member 231 and the third shaft member 314 from the floor between the filaments and the housing 100 and between the filaments and the detachable cover 320, or ② may move to the end of the rotating brush 310 along the grain of the filaments while adhering to the filaments, and then enter the first shaft member 231 and the third shaft member 314.

① is limited to occurring in the lower portion of the rotating brush 310. ② occurs constantly along the circumferential direction of the rotating brush 310. Accordingly, the foreign substances such as hair and dust mainly enter the first shaft member 231 and the third shaft member 314 from the lower portion of the rotating brush 310.

In the vacuum cleaner 1 according to the embodiments of the present disclosure, it is possible to prevent the foreign substances such as hair and dust from penetrating along the circumferential direction of the rotating brush 310, and since the second filaments 312B and the third filaments 312C increase in bulk density as they go toward the direction directly downward of the rotation axis, it is possible to reliably prevent the foreign substances such as hair and dust from penetrating from the lower portion of the rotating brush 310 through which the foreign substances mainly penetrate.

While the present disclosure has been explained in relation to its preferred embodiments, it is to be understood that various modifications thereof will become apparent to those skilled in the art upon reading the specification. Therefore, it is to be understood that the disclosure disclosed herein is intended to cover such modifications as fall within the scope of the appended claims.

The vacuum cleaner according to the embodiments of the present disclosure is industrially applicable in that since the first rib disposed along the circumference of the first shaft member protrudes from the housing in the direction of the rotation axis of the body such that the second and third filaments having a larger bulk density are disposed along the circumferential direction of the brush member, even if the foreign substances such as hair and dust adhering to the rotating brush move to the end of the rotating brush along the grain of the filaments, a phenomenon by which the foreign substances pass through the second and third filaments and then move toward the first shaft member is prevented.

What is claimed is:

1. A vacuum cleaner comprising:

a main body configured to generate an air pressure difference; and a suction nozzle configured to suction up dust on a floor based on the generated air pressure difference, wherein the suction nozzle comprises:

a housing including:

an entrance through which the dust travels to the main body;

a first shaft member; and a first rib disposed along a circumference of the first shaft member;

a driver installed in the housing and configured to rotate the first shaft member; and a rotating brush configured to rotate and direct the dust on the floor toward the entrance, wherein the rotating brush comprises:

a cylindrical body configured to be rotated by the first shaft member; and a brush member attached to an outer surface of the cylindrical body, the brush member being configured to rub against the floor and come into contact with the first rib, wherein the first rib comprises:

a first A rib formed at a distance from a rotation axis of the cylindrical body, the first A rib being formed along a circumferential direction around the rotation axis of the cylindrical body; and a first B rib provided under the rotation axis and positioned at a distance from the floor, the first B rib being parallel to the floor, wherein the brush member comprises a plurality of filaments configured to be elastically deformed by the floor and to direct the dust toward the entrance, and wherein at least some of the filaments are configured to be elastically deformed in a direction of the rotation axis by the first rib and have a higher packing density upon coming into contact with the first B rib than upon coming into contact with the first A rib.

2. The vacuum cleaner of claim 1, wherein the first rib protrudes from the housing in a direction of the rotation axis of the cylindrical body.

3. The vacuum cleaner of claim 2, wherein a radius of an outermost portion of the brush member centered on the rotation axis of the cylindrical body is greater than a distance between the rotation axis of the cylindrical body and the first rib.

4. The vacuum cleaner of claim 3, wherein the filaments comprise:

a plurality of first filaments spaced apart from the first rib;

a plurality of second filaments interposed between the outer surface of the cylindrical body and the first rib; and a plurality of third filaments configured to be elastically deformed in the direction of the rotation axis by the first rib, and wherein the second filaments and the third filaments have a higher packing density than the first filaments.

5. The vacuum cleaner of claim 4, wherein the second filaments and the third filaments have a higher packing density upon coming into contact with the first B rib than upon coming into contact with the first A rib.

6. The vacuum cleaner of claim 1, wherein the rotating brush rotates in engagement with the first shaft member, wherein the suction nozzle comprises a detachable cover that rotatably supports the rotating brush, the detachable cover being disposed opposite the first shaft member, and wherein the detachable cover includes a second rib configured to come into contact with the brush member.

7. The vacuum cleaner of claim 6, wherein the second rib protrudes from the detachable cover in a direction of the rotation axis of the cylindrical body.

8. The vacuum cleaner of claim 7, wherein a radius of an outermost portion of the brush member centered on the rotation axis of the cylindrical body is greater than a distance between the rotation axis of the cylindrical body and the second rib.

9. The vacuum cleaner of claim 8, wherein the brush member comprises a plurality of filaments configured to be elastically deformed by the floor and to push the dust toward the entrance, wherein the filaments comprise:

a plurality of first filaments spaced apart from the second rib;

a plurality of second filaments interposed between the outer surface of the cylindrical body and the second rib; and a plurality of third filaments configured to be elastically deformed in the direction of the rotation axis by the second rib, and wherein the second filaments and the third filaments have a higher packing density than the first filaments.

10. The vacuum cleaner of claim 9, wherein the second rib comprises:

a second A rib formed at a distance from the rotation axis of the cylindrical body, the second A rib being formed along the circumferential direction around the rotation axis of the cylindrical body; and a second B rib provided under the rotation axis and positioned at a distance from the floor, the second B rib being parallel to the floor, and wherein the second filaments and the third filaments increase in packing density as the second filaments and the third filaments travel in a direction from a position forward of the rotation axis to a position directly downward of the rotation axis.

11. A vacuum cleaner comprising:

a main body configured to generate an air pressure difference; and a suction nozzle configured to suction up dust on a floor based on the generated air pressure difference, wherein the suction nozzle comprises:

a housing, including:

an entrance through which the dust moves to the main body; and a first rib;

a driver installed in the housing;

a cylindrical body configured to be rotated by the driver; and a brush member attached to an outer surface of the cylindrical body and configured to rub against the floor, wherein the first rib is positioned to contact the brush member between the floor and the cylindrical body, wherein the first rib comprises:

a first A rib formed at a distance from a rotation axis of the cylindrical body, the first A rib being formed along the circumferential direction around the rotation axis of the cylindrical body; and a first B rib provided under the rotation axis and positioned at a distance from the floor, the first B rib being parallel to the floor, wherein the brush member comprises a plurality of filaments configured to be elastically deformed by the floor and to direct the dust toward the entrance, and wherein at least some of the filaments are configured to be elastically deformed in a direction of the rotation axis by the first rib and have a higher packing density upon coming into contact with the first B rib than upon coming into contact with the first A rib.

12. The vacuum cleaner of claim 11, further including a first shaft member disposed in an axial direction in the housing and configured to engage with the cylindrical body, wherein the driver is configured to rotate the first shaft member about the axial direction.

13. The vacuum cleaner of claim 12, further including:

a detachable cover configured to rotatably support the rotating brush, the detachable cover being disposed opposite the first shaft member; and a second rib protruding in the axial direction from the detachable cover and configured to come into contact with the brush member.

14. The vacuum cleaner of claim 11, wherein the first rib protrudes from the housing in the axial direction.

15. The vacuum cleaner of claim 11, wherein a radius of an outermost portion of the brush member relative to the rotation axis of the cylindrical body is greater than a distance between the rotation axis and the first rib.

16. The vacuum cleaner of claim 11, wherein the filaments include:

a plurality of first filaments spaced apart from the first rib;

a plurality of second filaments positioned between the outer surface of the cylindrical body and the first rib; and a plurality of third filaments positioned between the first filaments and the second filaments.

17. The vacuum cleaner of claim 16, wherein a first packing density of at least one of the second filaments and the third filaments is greater than a second packing density of the first filaments when the first, second, and third filaments are positioned adjacent the rib.

* * * * *